US008651279B2

(12) United States Patent
Malone et al.

(10) Patent No.: US 8,651,279 B2
(45) Date of Patent: Feb. 18, 2014

(54) CONTAINER SYSTEM

(71) Applicant: ConAgra Foods RDM, Inc., Omaha, NE (US)

(72) Inventors: Yolanda A. Malone, Ridgefield, CT (US); Catherine Shapiro, Omaha, NE (US); Svava Atladottir, Mountain Valley, CA (US); Lynda Deakin, Oakland, CA (US); John Dixon, Omaha, NE (US); JoAn Hernandez, Wayne, NJ (US); Stephen Kim, San Francisco, CA (US); Gina Romero, San Francisco, CA (US); Gabriel Trionfi, San Carlos, CA (US); Martin Zabaleta, Buenos Aires (AR); Lauren Shimek, San Ramon, CA (US)

(73) Assignee: ConAgra Foods RDM, Inc., Omaha, NE (US)

( * ) Notice: Subject to any disclaimer, the term of this patent is extended or adjusted under 35 U.S.C. 154(b) by 0 days.

(21) Appl. No.: 13/757,946

(22) Filed: Feb. 4, 2013

(65) Prior Publication Data

US 2013/0149417 A1 Jun. 13, 2013

Related U.S. Application Data

(63) Continuation of application No. 12/581,031, filed on Oct. 16, 2009, now abandoned.

(51) Int. Cl.
*A45C 11/20* (2006.01)

(52) U.S. Cl.
USPC ..... 206/541; 206/551; 220/526; 229/120.06; 229/902; 426/115

(58) Field of Classification Search
USPC ..... 206/541, 550, 549, 551, 568, 804; D09/425, 426; 220/522, 523, 526; 229/120.06, 120.07, 902, 904; 426/106, 109, 110, 115, 119, 120, 122, 426/123
See application file for complete search history.

(56) References Cited

U.S. PATENT DOCUMENTS

| | | | | | |
|---|---|---|---|---|---|
| 2,510,211 | A | | 6/1950 | Cleary | 229/120.32 |
| 3,937,389 | A | * | 2/1976 | Wind | 206/557 |
| D253,456 | S | * | 11/1979 | Payne | D9/426 |
| 4,465,190 | A | | 8/1984 | Cillario | 206/568 |
| 4,844,330 | A | | 7/1989 | Roosa et al. | 229/120.06 |
| 4,951,866 | A | | 8/1990 | Rusnak | 229/120.07 |
| 5,012,971 | A | | 5/1991 | Cozzi et al. | 229/120.07 |
| 5,205,413 | A | * | 4/1993 | Cautereels et al. | 206/541 |
| 5,676,244 | A | | 10/1997 | Green et al. | 206/221 |

(Continued)

*Primary Examiner* — Luan Bui
(74) *Attorney, Agent, or Firm* — Advent LLP; Ryan T. Grace

(57) ABSTRACT

A container system is described. In one or more implementations, the container system comprises a lower container for receiving a first food component (or components) and an upper container assembly for receiving a second food component (or components) so that the second food component is separated from the first food component. The upper container assembly is configured for engagement with the lower container and is operable to be at least partially opened while the upper container assembly is engaged with the lower container to introduce the second food component into the lower container with the first food component. In one or more embodiments, a pull tab is coupled to the upper container assembly. The pull tab is configured to be pulled while the upper container assembly is engaged with the lower container to at least partially open the upper container assembly.

14 Claims, 30 Drawing Sheets

(56) References Cited

U.S. PATENT DOCUMENTS

| | | | | |
|---|---|---|---|---|
| 6,048,558 | A | 4/2000 | Feldmeier et al. | 426/120 |
| 7,240,797 | B1 | 7/2007 | Grossman | 206/551 |
| 7,669,714 | B1 | 3/2010 | Grossman | 206/551 |
| 2004/0105917 | A1 | 6/2004 | Mannion et al. | 426/110 |
| 2007/0092610 | A1 | 4/2007 | Mize, Jr. | 426/120 |

* cited by examiner

CONTAINER SYSTEM

This application is a continuation of U.S. application Ser. No. 12/581,031 filed on Oct. 16, 2009, entitled CONTAINER SYSTEM, abandoned. The complete disclosure of the aforementioned application is incorporated herein by reference.

BACKGROUND

Since the development of the microwave oven, there has been a continuing consumer demand for microwave-ready packaged meals. In particular, consumers who are parents often purchase microwave-ready packaged meals for preparation by their children as a lunch, a bridge meal between regular meals, a snack, and so forth. Consequently, many packaged meals are designed to be prepared by children with a minimum of adult supervision, or no adult supervision at all. Thus, it is desirable to provide packaged meals for children that are nutritious, while being easy for the child to prepare with the least possible mess and cleanup. Moreover, preparation of microwave-ready packaged meals may provide an enjoyable and educational experience for the child as the child's first foray into cooking.

SUMMARY

A container system suitable for use in a microwave-ready packaged meal is described. In one or more implementations, the container system comprises a lower container for receiving a first food component (or components) and an upper container assembly for receiving a second food component (or components) so that the second food component is separated from the first food component. The upper container assembly is configured for engagement with the lower container and is operable to be at least partially opened while the upper container assembly is engaged with the lower container to introduce the second food component into the lower container with the first food component. In one or more embodiments, a pull tab is coupled to the upper container assembly (and/or the lower container). The pull tab is configured to be pulled while the upper container assembly is engaged with the lower container to at least partially open the upper container assembly (and/or the lower container).

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

DRAWINGS

The detailed description is described with reference to the accompanying figures. The use of the same reference numbers in different instances in the description and the figures may indicate similar or identical items.

DETAILED DESCRIPTION

Overview

Figure 1:
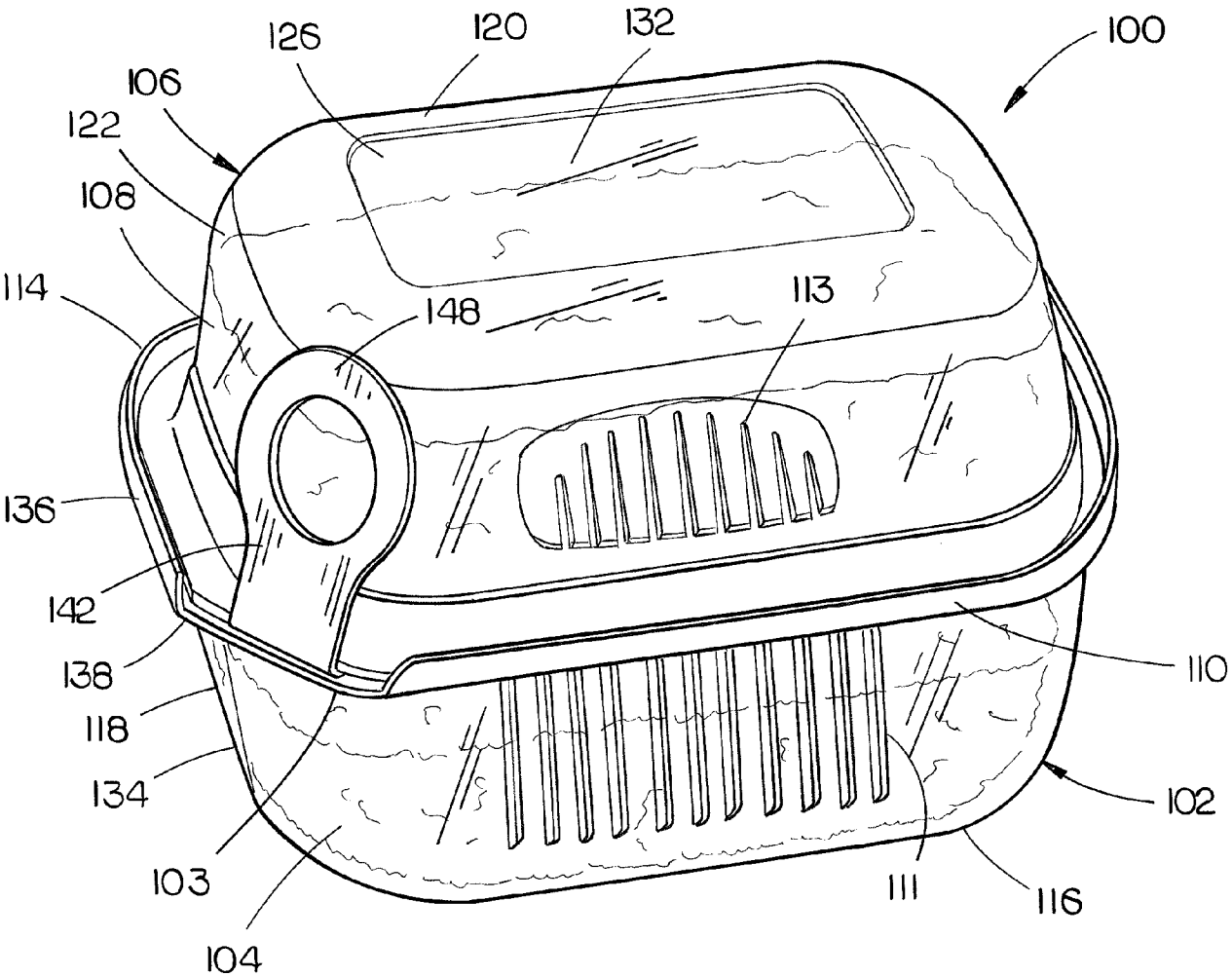
FIG. 1 is an isometric view illustrating a container system in an example implementation that comprises a lower container for receiving a first food component and an upper container assembly for receiving a second food component so that the second food component is separated from the first food component.

Reference will now be made in detail to the exemplary aspects of the present disclosure that are illustrated in the accompanying drawings. Wherever possible, the same reference numbers will be used throughout the drawings to refer to the same or like structure.

Microwave-ready packaged meals are commonly prepared by children, especially pre-teen or teenage children, as a lunch, a bridge meal between regular meals, a snack, and so forth. Consequently, it is desirable to provide packaged meals for children that are easy for the child to prepare with the least possible mess and cleanup since the meals may be prepared by children with a minimum of adult supervision, or no adult supervision at all. Moreover, it is desirable that the microwave-ready packaged meals provide an enjoyable and educational experience for the child.

Accordingly, a container system suitable for use in a microwave-ready packaged meal is described. The container system comprises a lower container for receiving a first food component of the meal and an upper container assembly for receiving a second food component of the meal so that the second food component is separated from the first food component. The upper container assembly is configured for engagement with the lower container and is operable to be at least partially opened to introduce the second food component into the lower container with the first food component.

In embodiments, the upper container assembly may be opened in a variety of ways. For example, the upper container assembly may include a seal member, bag, or similar component that is opened via actions such as peeling, puncturing (e.g., via a pulling or twisting motion, and so on), opening of a panel along a tear strip via directional propagation, material dissolution, and so on. In one or more embodiments, a pull tab is coupled to the upper container assembly, the lower container, or both the upper container assembly and the lower container, to facilitate opening of the upper container assembly and/or the lower container. The pull tab is configured to be pulled while the upper container assembly is engaged with the lower container.

The upper container assembly and lower container of the container system may be suitable for separably containing a plurality of food components, including meats, seafood, sauces, toppings, starches (e.g., pasta, rice, etc.), vegetables, potatoes, fruits, dairy products, and the like. For instance, in embodiments, the first food component contained in the lower container may comprise dried pasta, uncooked rice, or the like, while the second food component contained in the upper container assembly may comprise a sauce, which may include meat, vegetables, and so forth. Other combinations of food components are possible.

Any or all components of the container system described herein and contents of the container system such as the first and second food components may require processing to reach commercial sterility food products enclosed therein, such as thermal processing, aseptic techniques, hot-fill techniques, pasteurization techniques, and so forth. Thermal processing may refer to any process of cooking food within the package in which it is sold, such as meat or vegetables that need to cook at a particular temperature to kill any micro-organisms. Either or both of the upper and lower containers may be processed for commercial sterility. Moreover, processing of the upper and lower containers may occur separately to preserve the desired texture, flavor, appearance and other characteristics of the separate food components. The various components of the container system may then be assembled in the manners described, or in any manner suitable for assembling and packaging the food contents for sale and consumption.

Additionally, the food component contained in the upper or lower containers may comprise a dried food such as dried pasta or rice, a freeze dried, low moisture food, and so on, which may not require a distinct sterilization process during packaging.

The various components of the container system (e.g., the upper container assembly, the lower container, and so on) may be fabricated of a durable and reusable material such as a plastic, a polymer, a metal or metal alloy, extruded polystyrene foam, or like material, or may be composed of a disposable and easily biodegradable material, such as paper, or may be composed of any other material or combination of materials suitable for separably containing a variety of food components as described. For instance, the upper and lower containers of the container system may be constructed of a clarified, multi-layer structure or homo-polymeric material able to maintain dry and/or wet flowable products. In embodiments, the upper and lower containers may have pigments for various colors within the structures.

Accordingly, the container system provides a packaged meal that is easy to prepare with little mess and cleanup. Thus, the container system facilitates preparation of the food products contained therein by a child with little or no adult supervision. The container system may also furnish an enjoyable and/or educational experience for a child preparing the meal by providing a visible moment of transformation (e.g., mixing of the first and second food components) for the meal during the preparation process.

Example Container Systems

Referring generally to FIGS. 1 through 18D, example container systems 100 are described. The container systems 100 include a lower container 102 that is configured to receive a first food component 104 and an upper container assembly 106 that is configured to receive a second food component 108. As shown, the lower container 102 comprises a bowl structure 110 having an open top 112 defined by a rim 114. The bowl structure 110 includes a base 116 and a sidewall construction 118 that is generally continuous with the base 116 and extends from the base 116 to the rim 114. The lower container 102 may thus hold varying levels of the first food component (e.g., varying levels of a dry product such as pasta, rice, and so on).

In the examples shown in FIGS. 1 through 16, the upper container assembly 106 comprises a base 120 and a sidewall construction 122 that is continuous with the base 120 and extends from the base 120 to a lip 124. The base 120 and sidewall construction 122 thus define an interior cavity 126 having an orifice 128 bounded by the lip 124. In embodiments, one or more partition walls may be furnished to partition the interior cavity 126. Accordingly, the upper container assembly 106 may include a single interior cavity 126 or multiple (e.g., two or more) interior cavities 126 as shown in FIG. 15.

Figure 16:
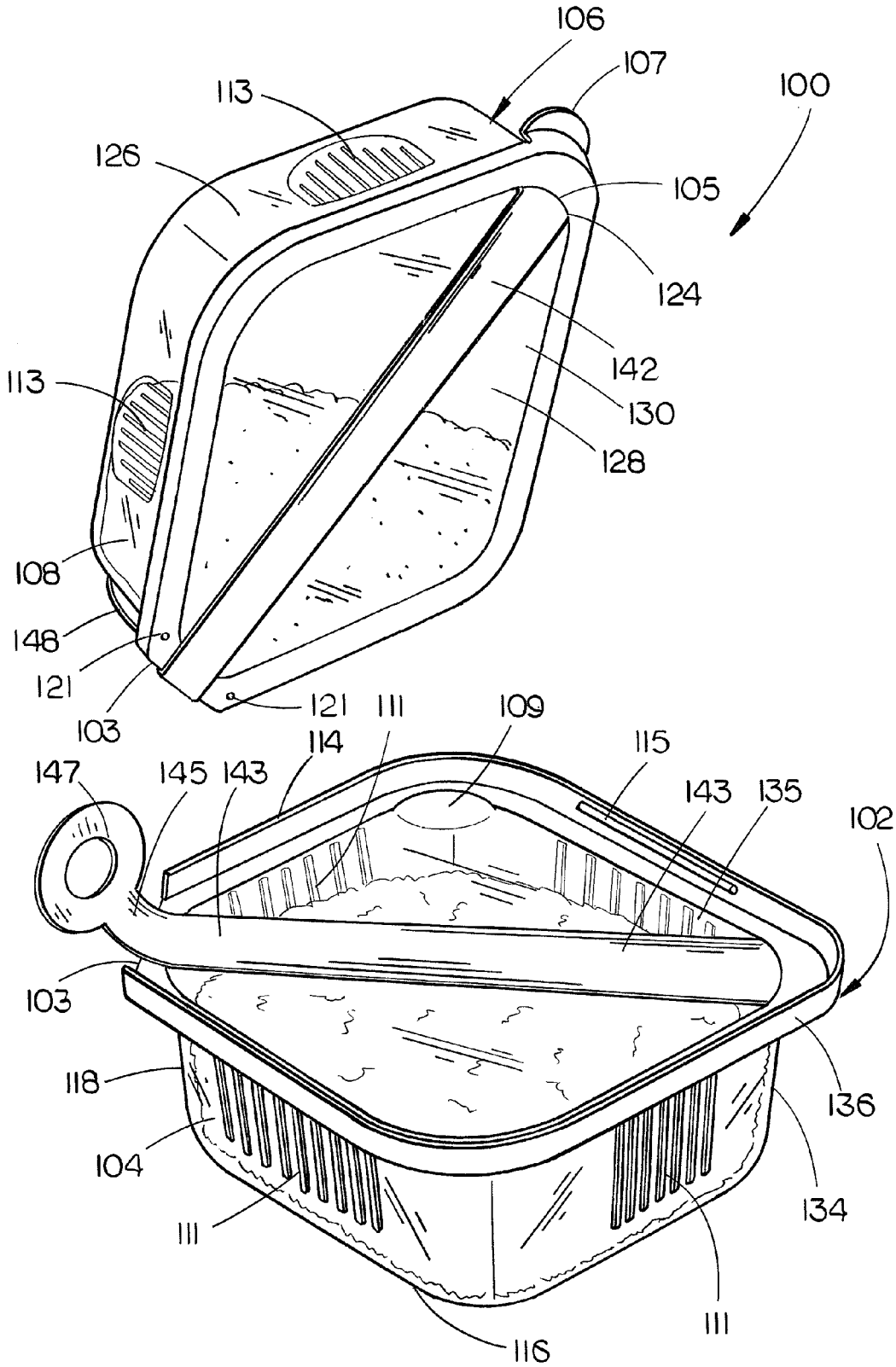
FIG. 16 is an exploded isometric view that illustrates a container system in an example implementation, wherein the lower container is provided with a second seal member.

A seal member 130 seals the orifice 128 so that the second food component 108 is contained within the interior cavity 126. The seal member 130 may hermetically seal the contents of the upper container assembly 106. It will be understood, however, that the scope of the present disclosure is not limited to a seal member 130 hermetically sealing the contents of the upper container assembly 106. For instance, it is contemplated that a second seal member may be provided for the lower container 102 (instead of, or in addition to, the seal member 130) to hermetically seal the lower container 102 as shown in FIG. 16. In embodiments, the seal member 130 may comprise of a film such as a biaxially-oriented polyethylene terephthalate (PET) polyester film, a metalized foil film, a paper, other laminations or co-extrusions, and so forth, affixed to the lip 124 (and/or the outer edge of any partition walls) via a suitable adhesive or adhesives. The seal member 130 may be at least partially removed, such as by peeling the seal member away from the lip 124 (and/or the outer edge of one or more partition walls), to allow the first food component to be emptied from the interior cavity 126 of the upper container assembly 106. The seal member 130 may further be printable, so that the seal member 130 may also function as a label (e.g., may include cooking directions, cautions, and so forth).

The upper container assembly 106 is configured for inverted engagement with the lower container 102 so that the base 120 of the upper container assembly 106 forms a top surface 132 of the assembled container system 100. For instance, as shown, the sidewall construction 118 of the lower container 102 may be formed to include a lower wall portion 134 and a containment wall 136 separated by a shoulder 138. The upper container assembly 106 may be inverted and received within the lower container 102 so that the upper container assembly 106 is supported by the shoulder 138 above the first food component 104 contained therein. In the embodiment illustrated, the lip 124 of the upper container assembly 106 is provided with an outwardly extending flange 140 that rests on the shoulder 138 to support the upper container assembly 106. The seal member 130, which seals the upper container assembly 106, thus separates the second food component 108 from the first food component 104 prior to preparation (e.g., mixing and cooking) of the first and second food components 104, 108.

The upper container assembly 106 is configured to be at least partially opened while the upper container assembly 106 is engaged with the lower container 102 to introduce the second food component 108 into the lower container 102 with the first food component 104. For instance, in the embodiment illustrated, the upper container assembly 106 includes a pull tab 142 that is pulled to separate (e.g., peel back) the seal member 130 from the lip 124 of the upper container assembly 106. In this manner, the second food component 108 is released from the interior cavity 126 of the upper container assembly 106 into the lower container 102 through orifice 128. As shown, the pull tab 142 extends from and is coupled to or integral with the seal member 130 along edge 144 of lip 124, and is folded against the seal member 130 so that an end 146 of the pull tab 142 extends from between the upper container assembly 106 and the lower container 102 (e.g., between shoulder 138 and flange 140) opposite edge 144.

The end 146 of the pull tab 142 may include a grip 148 (e.g., a ring structure, a reinforced section, a textured surface, combinations thereof, or the like) that may be gripped to facilitate pulling of the pull tab 142. As shown in FIG. 1, the grip 148 may be folded against the top surface 132 of the container system 100 (the base 120 of upper container assembly 106) and may be adhered to the top surface 132 and/or the sidewall construction 122 of the upper container assembly 106 prior to preparation, e.g., for shipping, display, storage, and the like). The pull tab 142 may formed as a single continuous structure, or may be fabricated of two or more components (e.g., a strip of film material and a textured grip).

As shown, the upper container assembly 106 may function as a cover or lid for the lower container 102. Thus, the container system 100 may further include a tamper-evident wrapping 150 such as a tamper-evident sleeve, tamper-evident shrink wrap, a tamper-evident seal, tamper-evident paper board, and so on. In some embodiments, a separate lid or cover (not shown) may be secured to the rim 114 of the lower container 102, for example, to retain the upper container assembly 106 in engagement with the lower container 102 and to seal the lower container 102. A variety of lid/cover configurations are possible.

In the illustrated examples, the upper container assembly 106 rests on shoulder 138 of the lower container 102 in a stacked arrangement. This stacked arrangement allows for easy de-nesting of the upper container assembly 106 from the lower container 102. In other embodiments, the upper container assembly 106 may provide a secure closure that may employ a number of connection techniques. For example, upper container assembly 106 may be secured to lower container 102 via a snap fit connection, a friction fit connection, a squeeze and lift fit connection, a twist and lift connection, and so on. Further, the container system 100 may include features that allow for ease of use. Such features may include, but are not limited to: a lid such as a snap closed lid, dust protection, apparatus configured to reduce the possibility of a user (e.g., a consumer) touching a heated surface (e.g., handles, flutes, ribs, fins, etc.), recessed areas that allow removal of the upper container assembly from the lower container, handles that facilitate transport of the container system 100, a shape that is ergonomically configured to fit within a human hand, and so forth.

A venting structure may be provided between the lip 124 (e.g., the flange 140) of the upper container system and the shoulder 138 of the lower container system to release steam and other gases during cooking of the first and second food components 104, 108 in the lower container 102. For example, ridges or indents may be provided in one or both of the flange 140 and the shoulder 138 to create a gap through which steam and other gasses generated during cooking may pass. An example venting structure is illustrated in FIG. 2.

The various components of the container system 100 may include one or more surfaces to which a label or labels 152 may be affixed. Labels 152 may include a variety of indicia such as product names, logos, ingredient information, nutrition information, manufacturer contact information, preparation instructions, and so on.

It will be appreciated that the container system 100 may have a variety of shapes and configurations. For example, in FIGS. 1 and 4, the container system 100 is illustrated as comprising a base 116 that is generally rectangular in shape so that the sidewall construction 118 includes four sidewalls, while in FIG. 7, the example container system 100 may have an oval or round base 116 so that the sidewall construction 118 comprises a single generally curved sidewall. It is contemplated that the container system 100 may have other configurations without departing from the scope and spirit of the present disclosure. Further, it is contemplated that the shape of the container system 100 may be selected so that the seal member 130 of the upper container assembly 106 provides a hermetic seal that is capable of surviving a retort process, such as described above, distribution to retailers, storage, and so forth, while providing a low opening force (e.g., a low pull force applied to the pull tab 142 to separate the seal member 130 from the lip 124). For instance, in embodiments, the lip 124 and seal member 130 of the upper container assembly 106 are shaped to provide a peel initiation chevron and may utilize an adhesive that work together to provide improved peel ability while maintaining a hermetic seal (see FIG. 2). Other configurations are possible.

Figure 2:
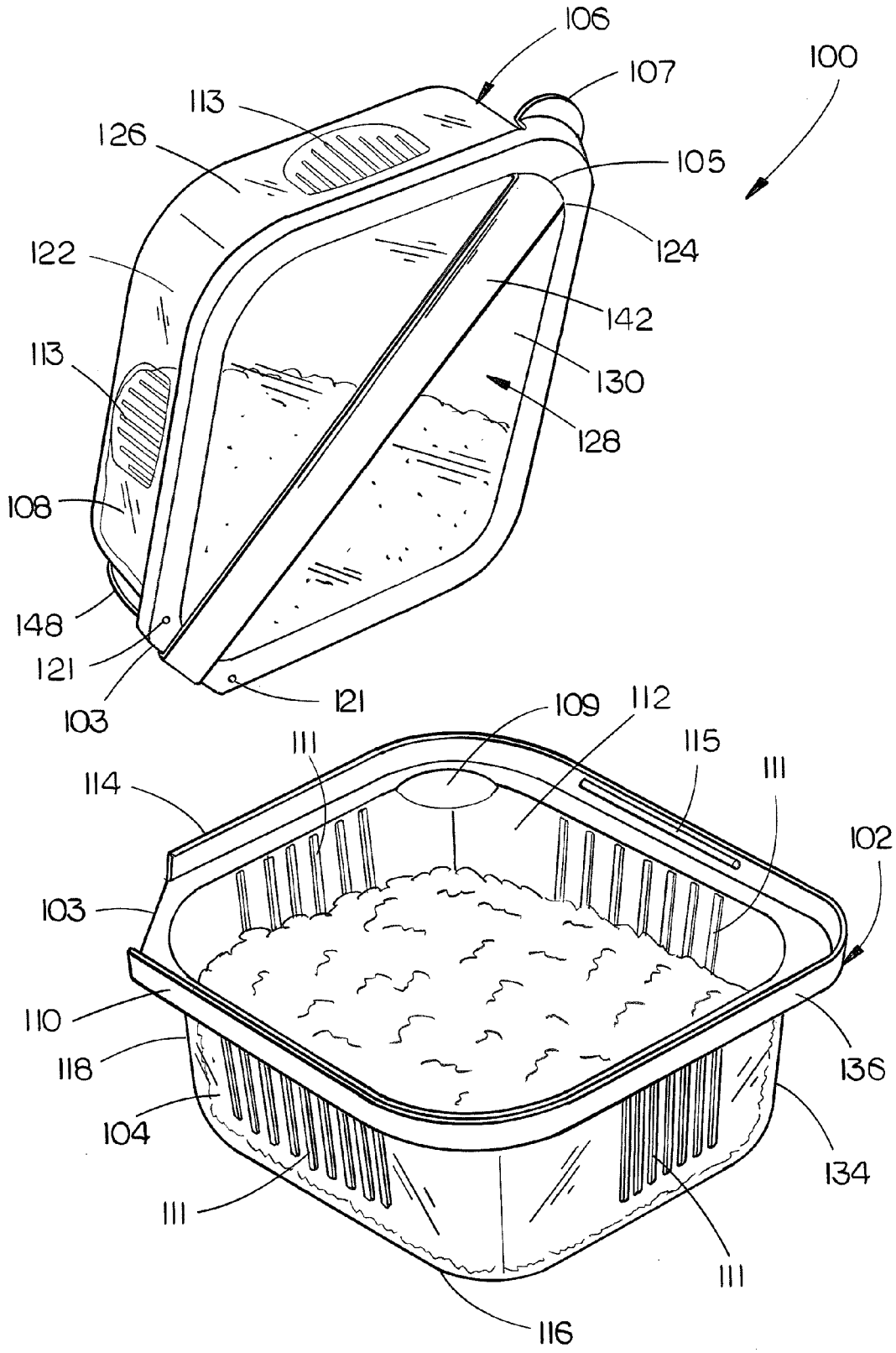
FIG. 2 is an exploded isometric view of the container system shown in FIG. 1, further illustrating components of the container system.

In the example shown in FIGS. 1 and 2, a corner of the rim 114 of the lower container 102 is illustrated as being truncated to form a diagonal edge 103 along which the height of the containment wall 136 is reduced (e.g., so that the containment wall 136 does not extend substantially above the shoulder 138). A corresponding corner of the lip 124 and flange 140 of the upper container assembly 106 are likewise truncated so that the flange 140 follows the shoulder 138 along the diagonal edge 103 when the upper container assembly 106 is engaged with the lower container 102. One or more beads 121 formed in the flange 140 and/or the shoulder 138 provides separation between the flange 140 and the shoulder 138 to furnish clearance through which the pull tab 142 may pass.

The seal member 130 is separated along a line extending diagonally between the diagonal edge 103 and a corner opposite the diagonal edge 103. The corner of the lip 124 opposite the truncated corner may be shaped to provide a peel initiation chevron 105 to initiate separation of the seal member 130 from the lip 124 when the pull tab 142 is pulled. In embodiments, the seal member 130 may be adhered to a first portion of the lip 124 opposite the diagonal edge 103 with a first adhesive and to a second portion of the lip 124 adjacent to the diagonal edge 103 with a second adhesive (or an additional amount of the first adhesive). In this manner, the seal member 130 may separate from the first portion of the lip 124, but remain adhered to a second portion of the lip 124 as the pull tab 142 is pulled so that the seal member remains contained within the lower container 102. The lip 124 of the upper container assembly 106 may further include a lift tab 107 to facilitate removal of the upper container assembly 106 from the lower container assembly 102.

Venting structures 109 may be provided in the shoulder 138 of the lower container 102. In the example shown, the venting structures 109 comprise indentations that create a gap between the shoulder 138 and the flange 140 through which steam and other gases may be released during cooking of the first and second food components 104, 108 in the lower container 102.

One or both of the lower container 102 and the upper container assembly 106 may include insulative features 111, 113 that allow for comfortable handling of the lower container 102 and/or the upper container assembly 106 following microwaving/cooking of the first and second food components 104, 106 contained therein. For example, insulative features 111, 113 may comprise shapes molded into the sidewall assemblies 118, 122 of lower container 102 and/or the upper container assembly 106 that provide insulative characteristics to the sidewall assemblies 118, 122, secondary material features applied to the outside of the sidewall assemblies 118, 122, and so forth.

Figure 3A:
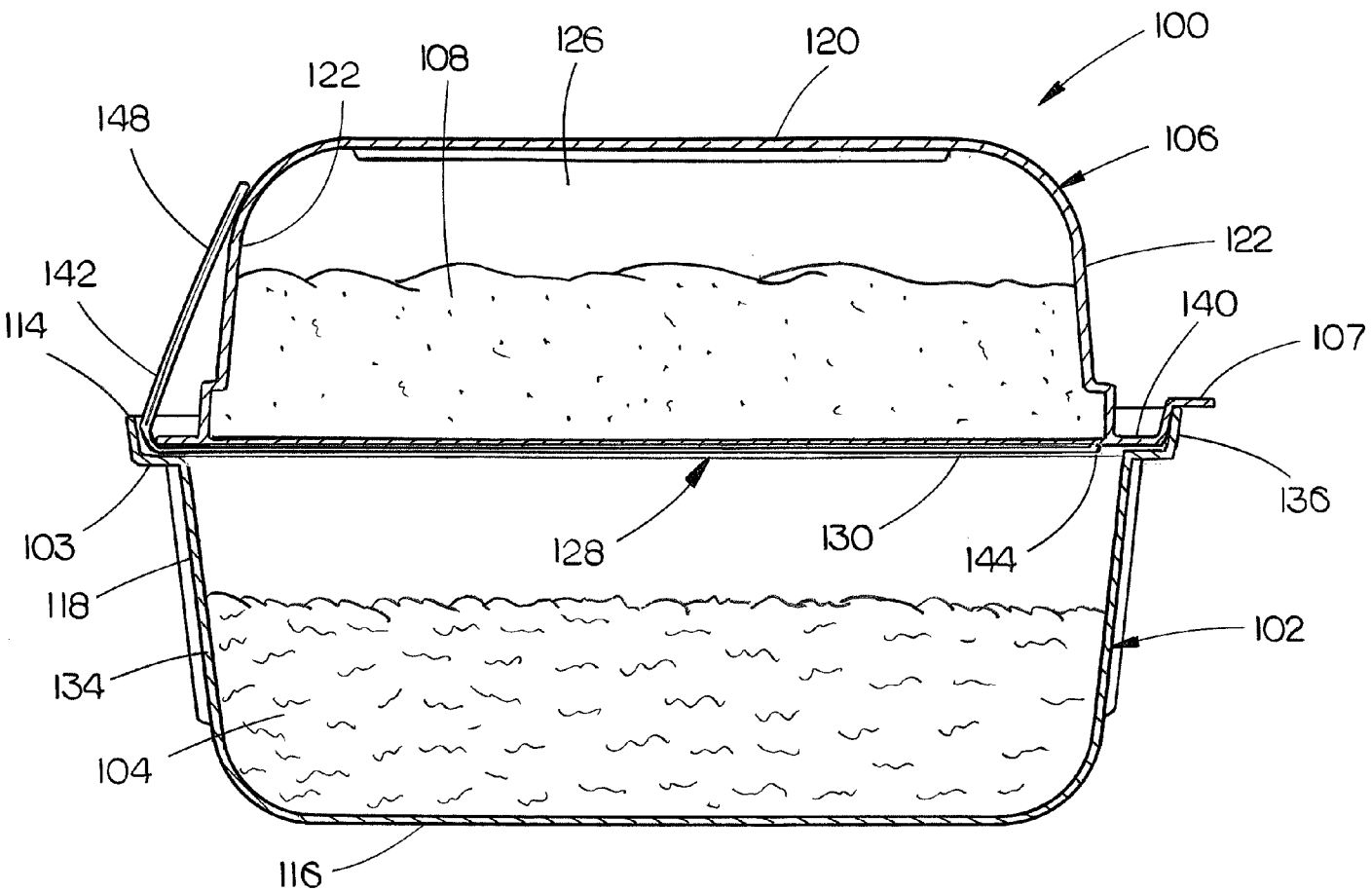
FIG. 3A is a cross-sectional side elevational view of the container system shown in FIG. 1, wherein the container system is depicted prior to opening of the upper container assembly.

FIGS. 3A through 3D illustrate preparation of the contents of the example container system 100 shown in FIGS. 1 and 2. In FIG. 3A, the container system 100 is depicted prior to opening of the upper container assembly 106. The seal member 130 seals the upper container assembly 106 to contain the second food component 108 within the interior cavity 126 so that the second food component 108 is separated from the first food component 104 contained in the lower container 102. The pull tab 142 is folded against the seal member 130 so that an end 146 of the pull tab 142 extends from between the flange 140 of the upper container assembly 106 and the shoulder 138 of the lower container 102 along diagonal edge 103.

Figure 3B:
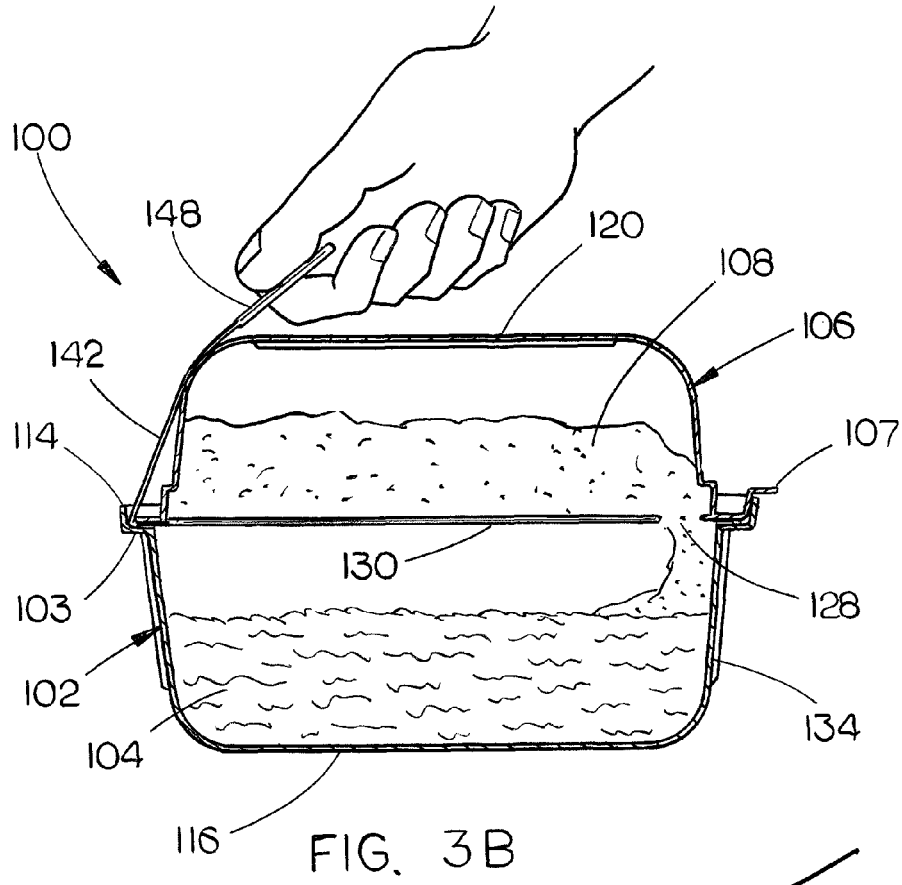
FIG. 3B is a cross-sectional side elevational view of the container system shown in FIG. 1, wherein the container system is depicted during opening of the upper container assembly.

In FIG. 3B, the container system 100 is depicted during opening of the upper container assembly 106. As shown, the grip 148 of pull tab 142 is grasped (e.g., by a consumer) to pull the pull tab 142. As the pull tab 142 is pulled, the seal member 130 is separated (e.g., peeled back) from the lip 124 of the upper container assembly 106. In this manner, the second food component 108 is released from the interior cavity 126 into the lower container 102 through the unsealed portion of orifice 128.

Figure 3C:
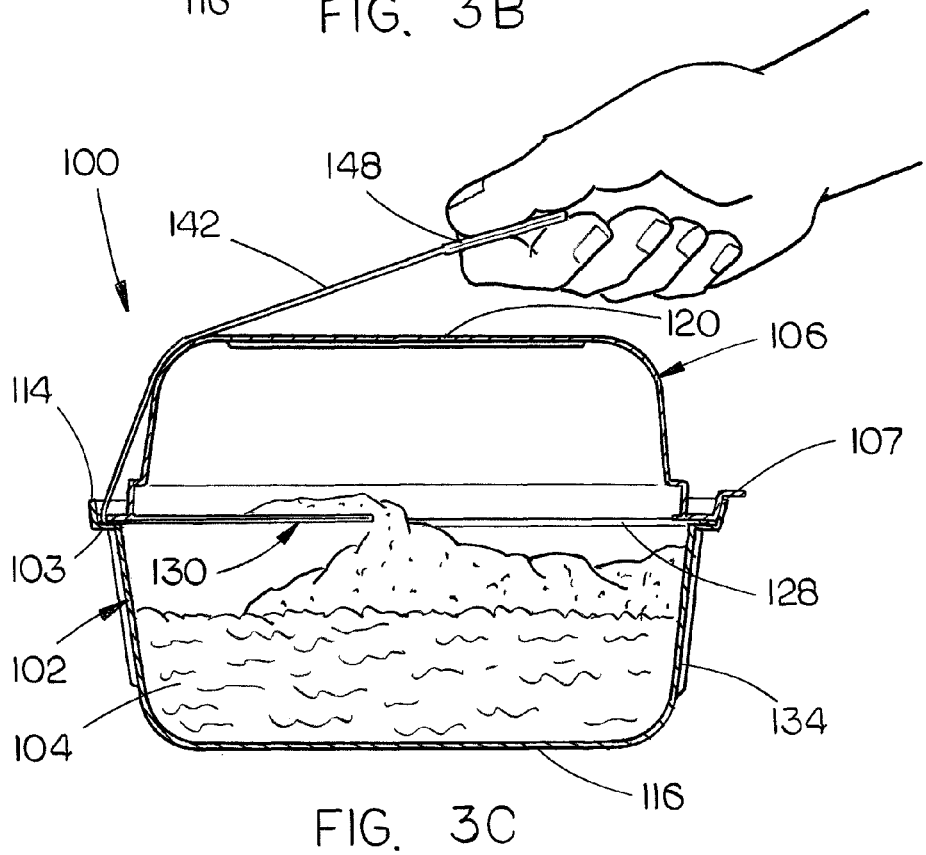
FIG. 3C is a cross-sectional side elevational view of the container system shown in FIG. 1, wherein the container system is depicted following opening of the upper container assembly.

In FIG. 3C, the container system is depicted after the upper container assembly 106 is fully opened. As shown, the seal member 130 is shown separated from a first portion of the lip 124, but remains adhered to a second portion of the lip adjacent to diagonal edge 103. Thus, when fully opened, the seal member 130, which may have residue of the second food component 108 on its surface, remains within the lower container 102. In some implementations, the container system 100 may be shaken gently to mix the second food component 108 into the first food component 104.

Figure 3D:
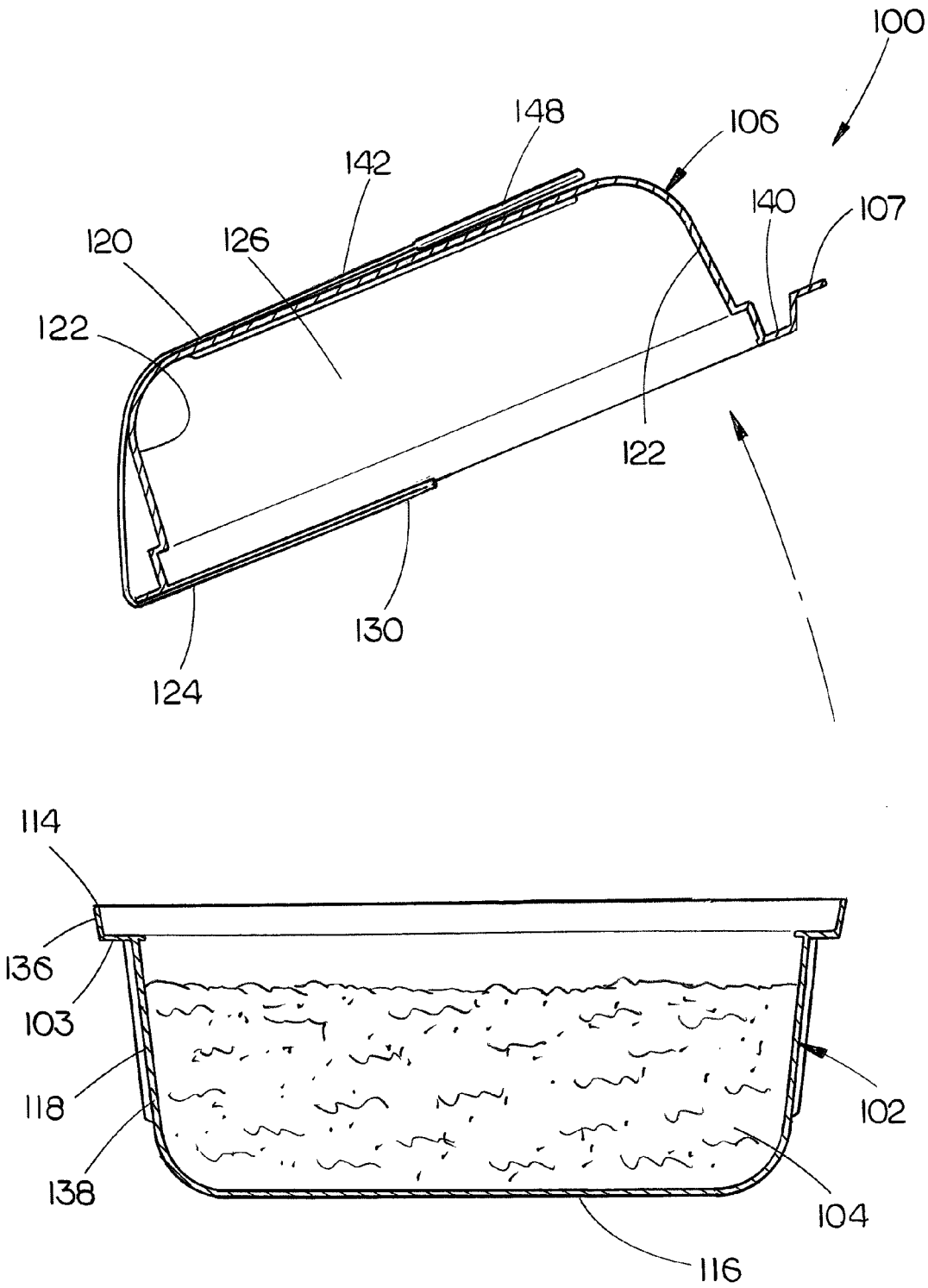
FIG. 3D is a is a cross-sectional side elevational view of the container system shown in FIG. 1, wherein the container system is depicted after the upper container assembly is removed from the lower container.

In FIG. 3D, the container system 100 is depicted after the upper container assembly 106 is removed from the lower container 102 following cooking of the first and second food components 104, 108. In embodiments, flange 140 of the upper container assembly 106 may be retained against the shoulder 138 of the lower container 102 via a ridge 115 formed in the containment wall 136 that is configured to engage the flange 140 (e.g., to provide a snap fit). The upper container 106 may be removed from the lower container 102 via application of an upward force to the lift tab 107, which lifts the flange 140 past the ridge 115. The upper container 106 may also be removed from the lower container 102 by compressing the sidewall assembly 122 of the upper container assembly 106 (e.g., by applying inward compressive forces to the sidewall assembly 122 at insulative feature 113) so that the flange 140 may be lifted past the ridge 115.

Figure 4:
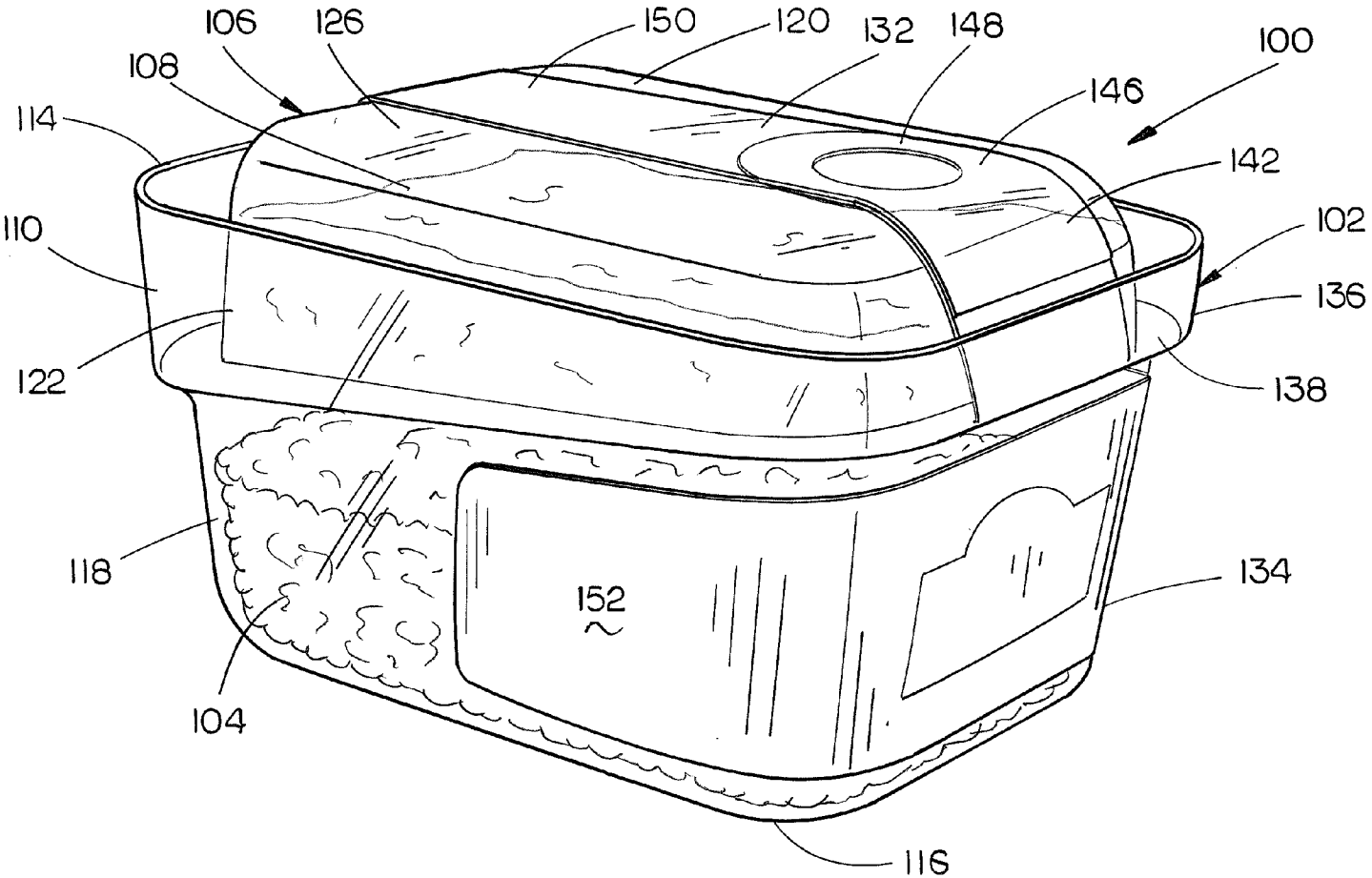
FIG. 4 is an isometric view illustrating a container system in an example implementation, wherein the upper container assembly is held at an angle by the lower container assembly to facilitate flow of the second food product into the lower container.
Figure 5:
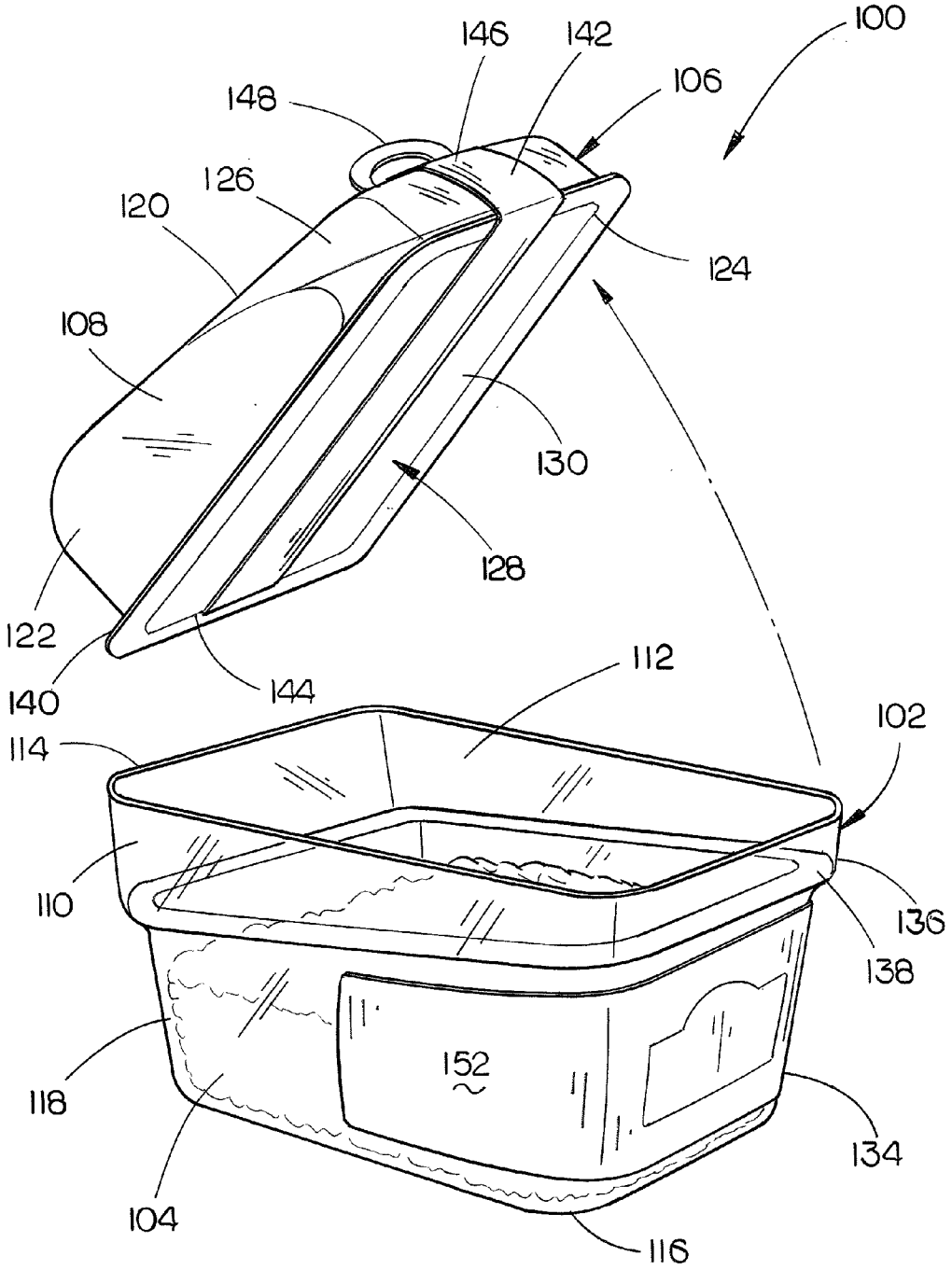
FIG. 5 is an exploded isometric view of the container system shown in FIG. 4, further illustrating components of the container system.

In the example shown in FIGS. 4 and 5, the seal member 130 is again partially separated from the lip 124 of the upper container assembly 106 by the pull tab 142, but remains attached to the lip 124 and contained within the lower container 102. For example, the seal member 130 may be adhered to a first portion of the lip 124 adjacent to edge 144 with a first adhesive and to a second portion of the lip 124 opposite edge 144 with a second adhesive (or an additional amount of the first adhesive). In this manner, the seal member 130 may separate from the first portion of the lip 124, but remain adhered to a second portion of the lip 124 as the pull tab 142 is pulled.

As noted in the discussion above, the sidewall construction 118 of the lower container 102 is formed to include a lower wall 134, a shoulder 138, and a containment wall 136 extending from the shoulder 138. The upper container assembly 106 is supported on the shoulder 138 so that the seal member 130 is disposed within the containment wall 136 to prevent or reduce possibility of spillage of the second food component 108 from the upper container assembly 106. In FIGS. 4 and 5, the shoulder 138 is illustrated as being slanted with respect to the base 116 to hold the upper container assembly 106 at an angle with respect to the base. This orientation facilitates flow of the second food component 108 from the interior cavity 126 through the orifice 128 when the upper container assembly 106 is opened. Similarly, the base 120 of the upper container assembly 106 may be slanted with respect to lip 124 so that base 120 of the upper container assembly 106 is substantially parallel with the base 116 of the lower container 102 (e.g., so that the top surface 132 of the container system 100 is substantially level to facilitate stacking and/or storage of the container system 100.)

FIGS. 6A through 6D illustrate preparation of the contents of the example container system 100 shown in FIGS. 4 and 5. In FIG. 3A, the container system 100 is depicted prior to opening of the upper container assembly 106. The tamper-evident wrapping 150 has been removed and the grip 148 of pull tab 142 has been lifted. The seal member 130 seals the upper container assembly 106 to contain the second food component 108 within the interior cavity 126 so that the second food component 108 is separated from the first food component 104 contained in the lower container 102. The pull tab 142 is folded against the seal member 130 so that an end 146 of the pull tab 142 extends from between the flange 140 of the upper container assembly 106 and the shoulder 138 of the lower container 102 opposite edge 144.

Figure 6A:
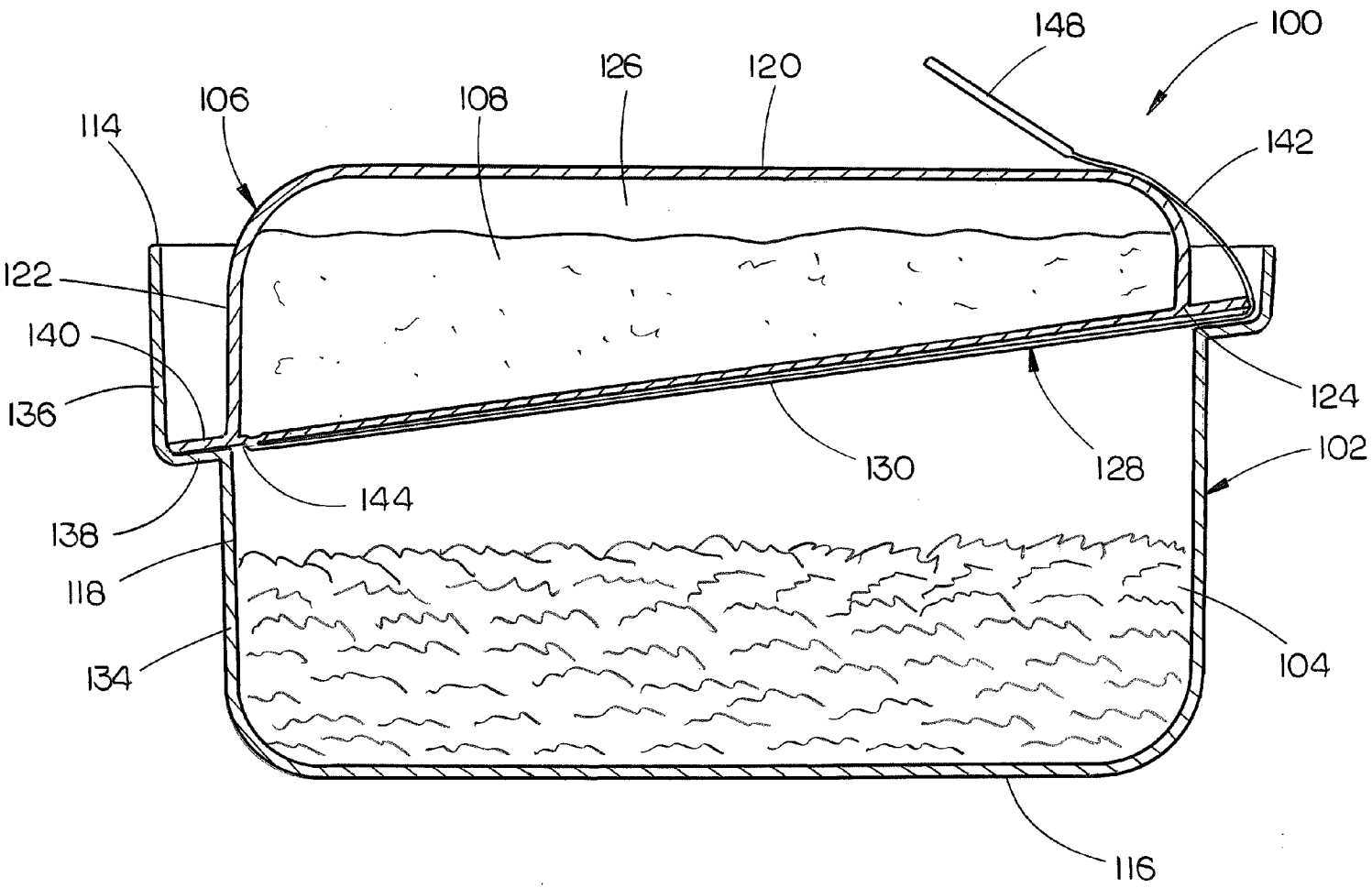
FIG. 6A is a cross-sectional side elevational view of the container system shown in FIG. 4, wherein the container system is depicted prior to opening of the upper container assembly.
Figure 6B:
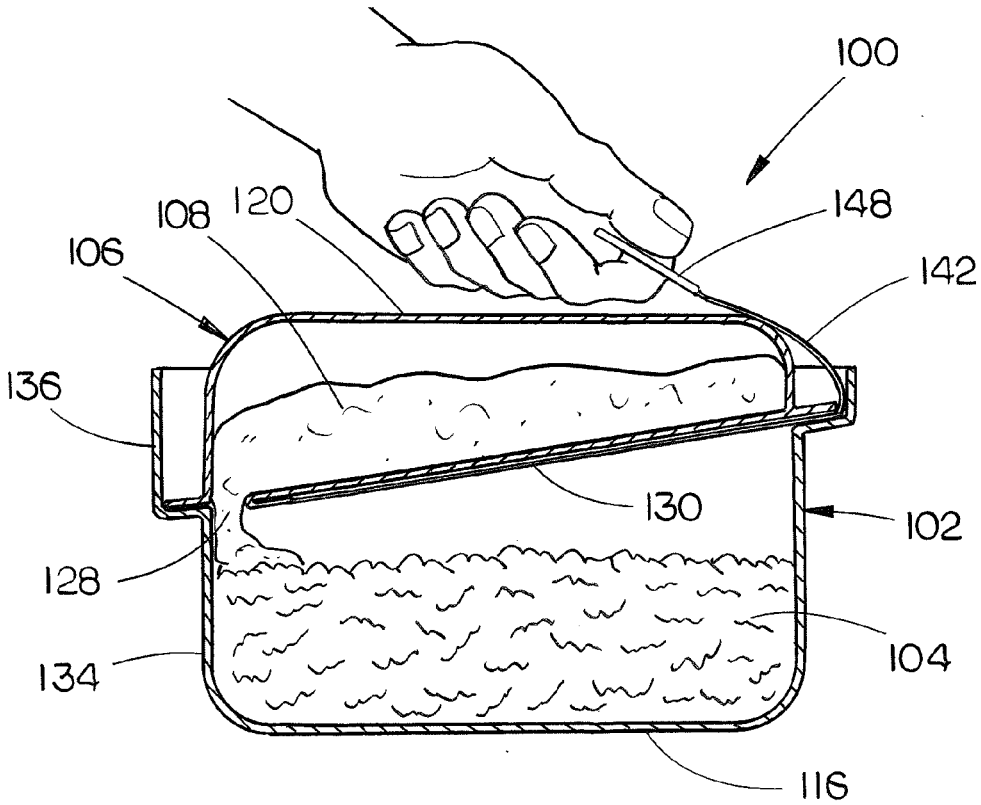
FIG. 6B is a cross-sectional side elevational view of the container system shown in FIG. 4, wherein the container system is depicted during opening of the upper container assembly.

In FIG. 6B, the container system 100 is depicted during opening of the upper container assembly 106. As shown, the grip 148 of pull tab 142 is grasped (e.g., by a consumer) to pull the pull tab 142. As the pull tab 142 is pulled, the seal member 130 is separated (e.g., peeled back) from the lip 124 of the upper container assembly 106. In this manner, the second food component 108 is released from the interior cavity 126 into the lower container 102 through the unsealed portion of orifice 128. In the embodiment illustrated, the shoulder 138 of the lower container 102 is slanted with respect to its base 116 so that the upper container assembly 106 is held at an angle. Thus, the seal member 130 is provided with a downward slope toward edge 144 when the container system 100 is held generally level (e.g., is placed on a horizontal surface). This downward slope facilitates flow of the second food component 108, which may be a fluid or a flowable solid, through orifice 128 as the seal member 130 is separated (e.g., peeled back) from the lip 124.

Figure 6C:
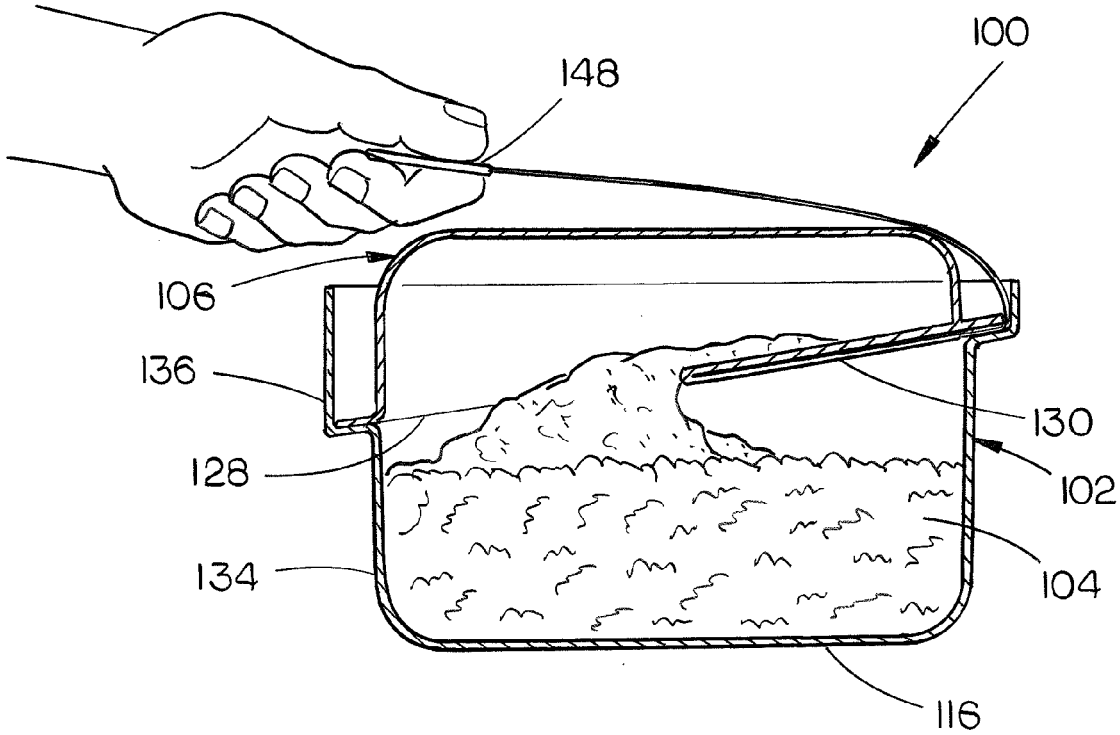
FIG. 6C is a cross-sectional side elevational view of the container system shown in FIG. 4, wherein the container system is depicted following opening of the upper container assembly.

In FIG. 6C, the container system is depicted after the upper container assembly 106 is fully opened. As shown, the seal member 130 is shown separated from a first portion of the lip 124, but remains adhered to a second portion of the lip 124 opposite edge 144. In embodiments, the second portion of lip 124 may have a width that is equal to or greater than the width of the first portion. Thus, when fully opened, the seal member 130, which may have residue of the second food component 108 on its surface, remains within the lower container 102. In some implementations, the container system 100 may be shaken gently to mix the second food component 108 into the first food component 104.

Figure 6D:
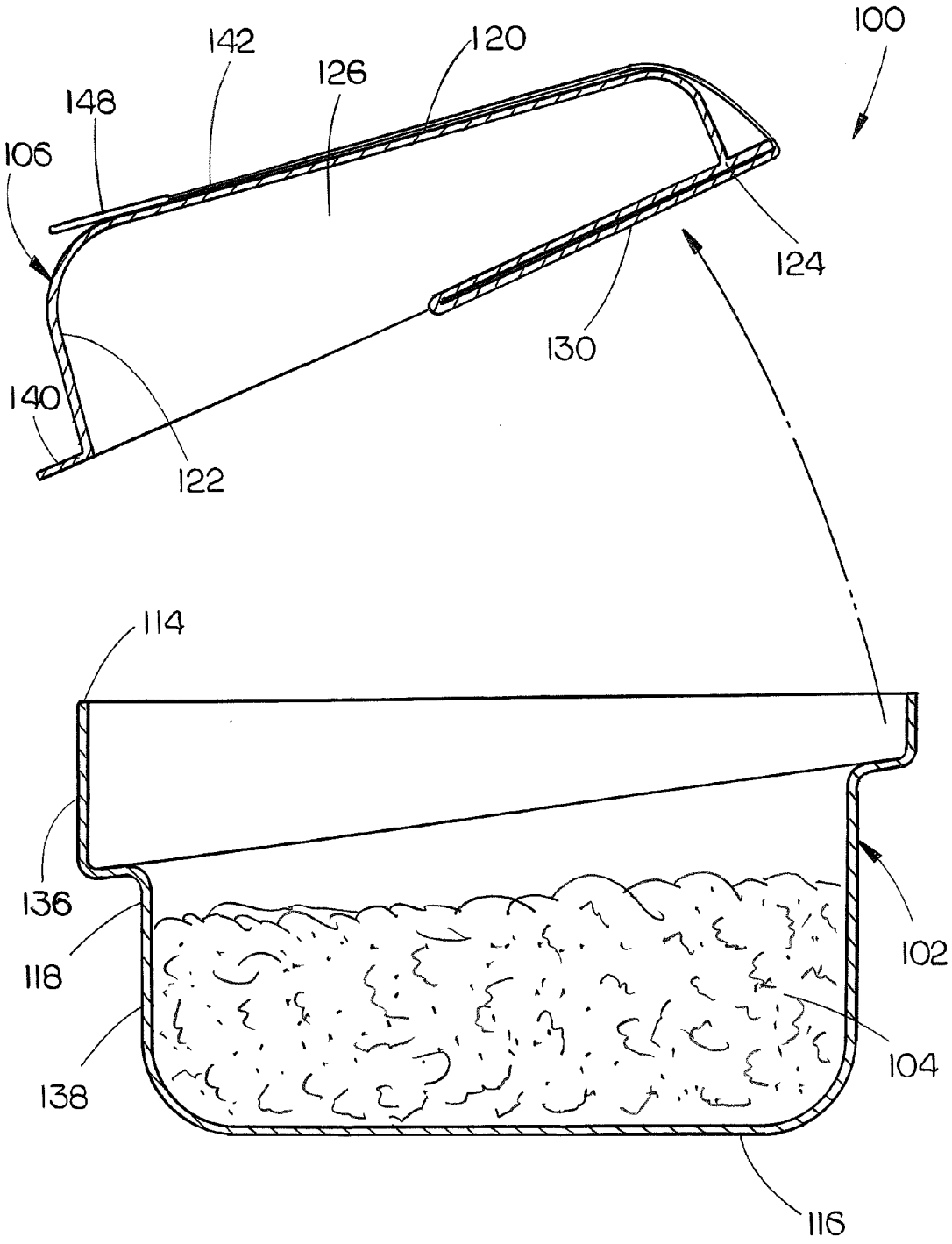
FIG. 6D is a is a cross-sectional side elevational view of the container system shown in FIG. 4, wherein the container system is depicted after the upper container assembly is removed from the lower container.

In FIG. 6D, the container system 100 is depicted after the upper container assembly 106 is removed from the lower container 102 following cooking of the first and second food components 104, 108.

Figure 7:
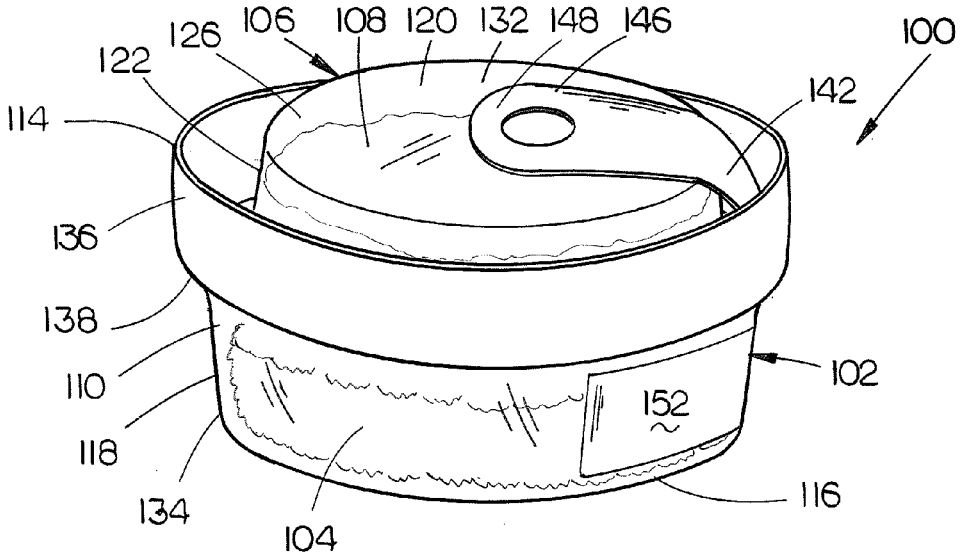
FIG. 7 is an isometric view illustrating a container system in another example implementation.
Figure 8:
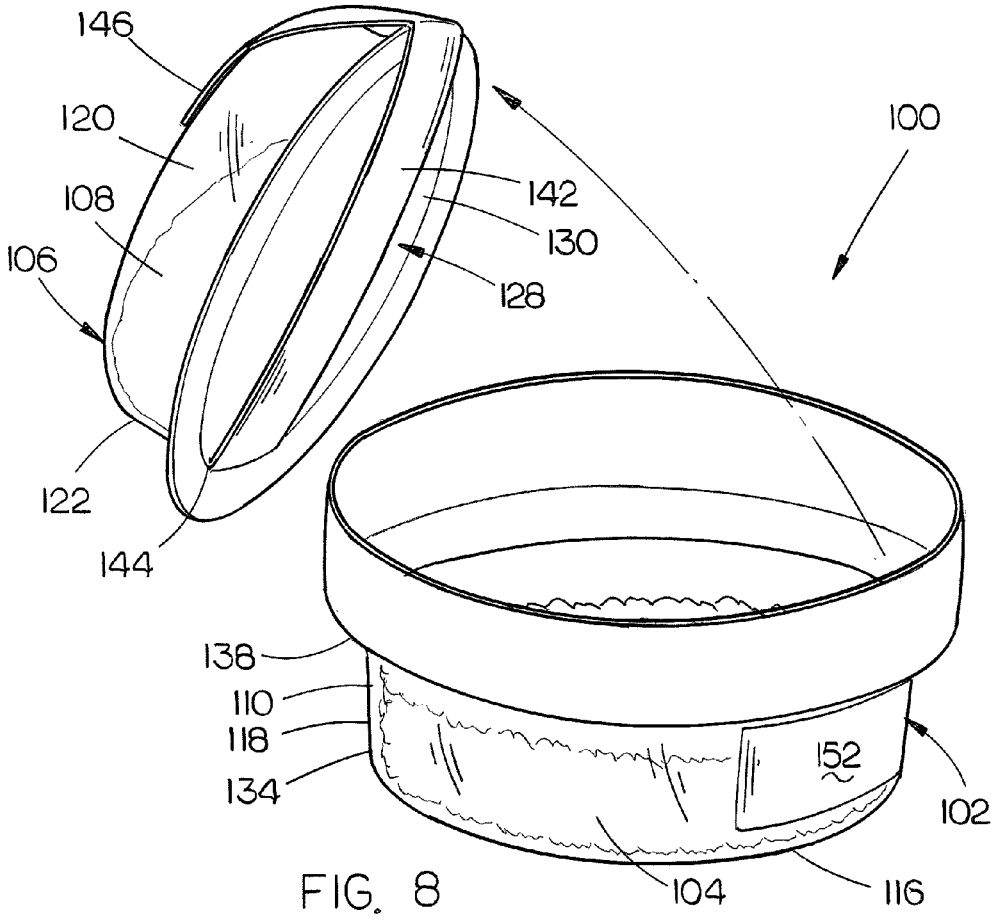
FIG. 8 is an exploded isometric view of the container system shown in FIG. 7, further illustrating components of the container system.

In the example shown in FIGS. 7 and 8, the seal member 130 is separated from the lip 124 of the upper container assembly 106 by the pull tab 142, and is removed from the container system 100 so that orifice 128 is fully opened. As illustrated, the shoulder 138 is configured to be generally parallel to the base 116 instead of being slanted with respect to the base 116 as in the container system 100 shown in FIGS. 4 and 5

Figure 9A:
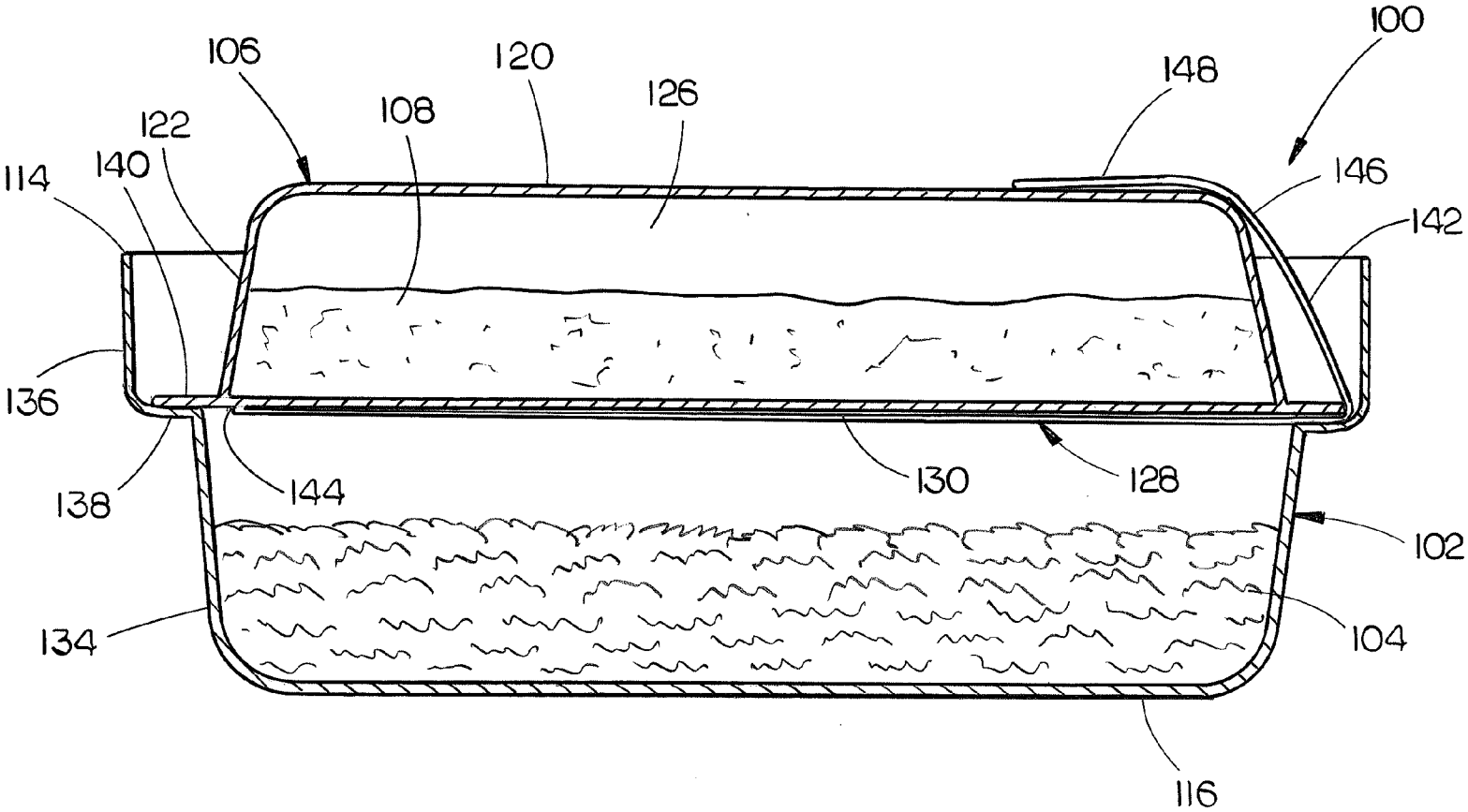
FIG. 9A is a cross-sectional side elevational view of the container system shown in FIG. 7, wherein the container system is depicted prior to opening of the upper container assembly.

FIGS. 9A through 9D illustrate preparation of the contents of the example container system 100 shown in FIGS. 7 and 8. In FIG. 9A, the container system 100 is depicted prior to opening of the upper container assembly 106. The seal member 130 seals the upper container assembly 106 to contain the second food component 108 within the interior cavity 126 so that the second food component 108 is separated from the first food component 104 contained in the lower container 102. As noted, the pull tab 142 is folded against the seal member 130 so that an end 146 of the pull tab 142 extends from between the flange 140 of the upper container assembly 106 and the shoulder 138 of the lower container 102 opposite edge 144.

Figure 9B:
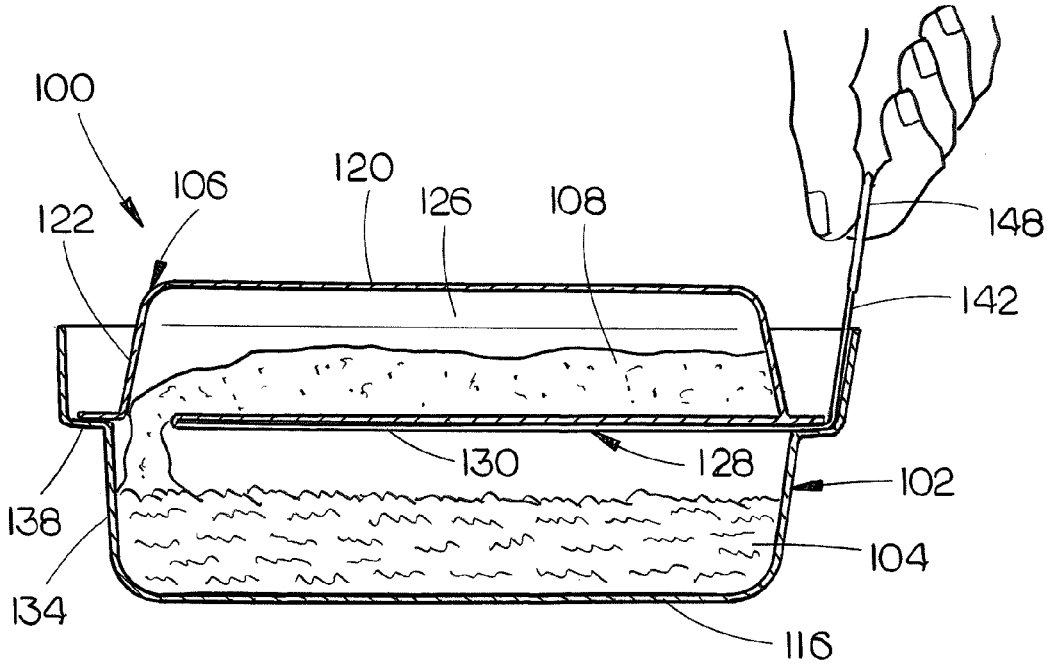
FIG. 9B is a cross-sectional side elevational view of the container system shown in FIG. 7, wherein the container system is depicted during opening of the upper container assembly.

In FIG. 9B, the container system 100 is depicted during opening of the upper container assembly 106. As shown, the grip 148 of pull tab 142 is grasped (e.g., by a consumer) to pull the pull tab 142. As the pull tab 142 is pulled, the seal member 130 is separated (e.g., peeled back) from the lip 124 of the upper container assembly 106. The second food component 108 is released from the interior cavity 126 of the upper container assembly 106 into the lower container 102 through orifice 128

Figure 9C:
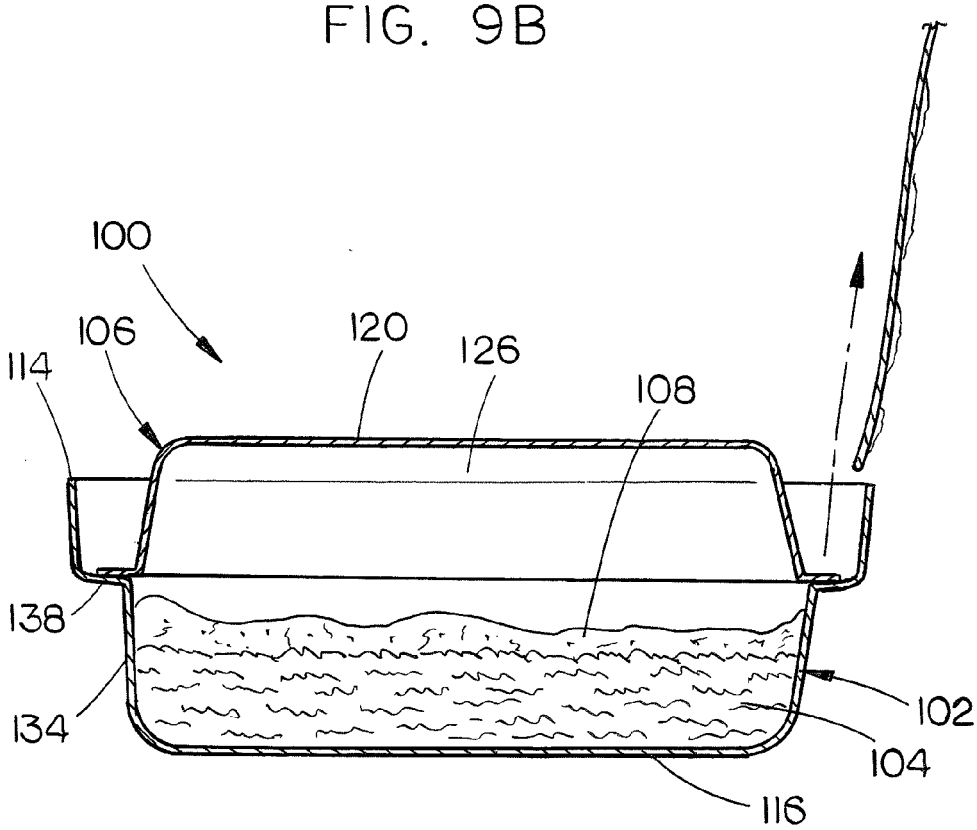
FIG. 9C is a cross-sectional side elevational view of the container system shown in FIG. 7, wherein the container system is depicted following opening of the upper container assembly.

In FIG. 9C, the container system 100 is depicted following opening of the upper container assembly 106. As shown, seal member 130 is removed from the upper container assembly 106 and the second food component 108 fully introduced into the lower container 102 with the first food component 104. In some implementations, the container system 100 may be shaken gently to mix the second food component 108 into the first food component 104.

Figure 9D:
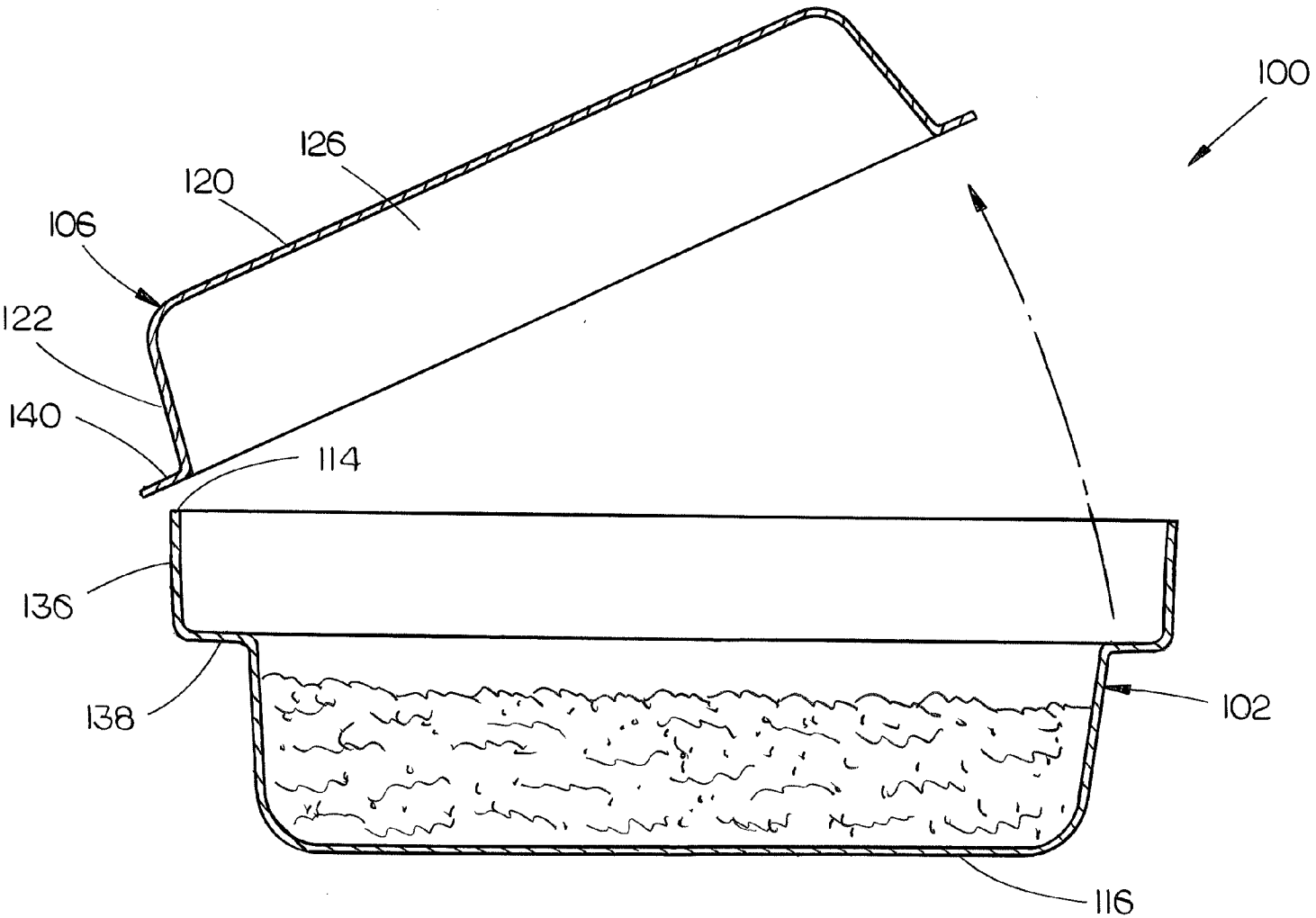
FIG. 9D is a is a cross-sectional side elevational view of the container system shown in FIG. 7, wherein the container system is depicted after the upper container assembly is removed from the lower container.

In FIG. 9D, the container system 100 is depicted after the upper container assembly 106 is removed from the lower container 102 following cooking of the first and second food components 104, 108.

Figure 10:
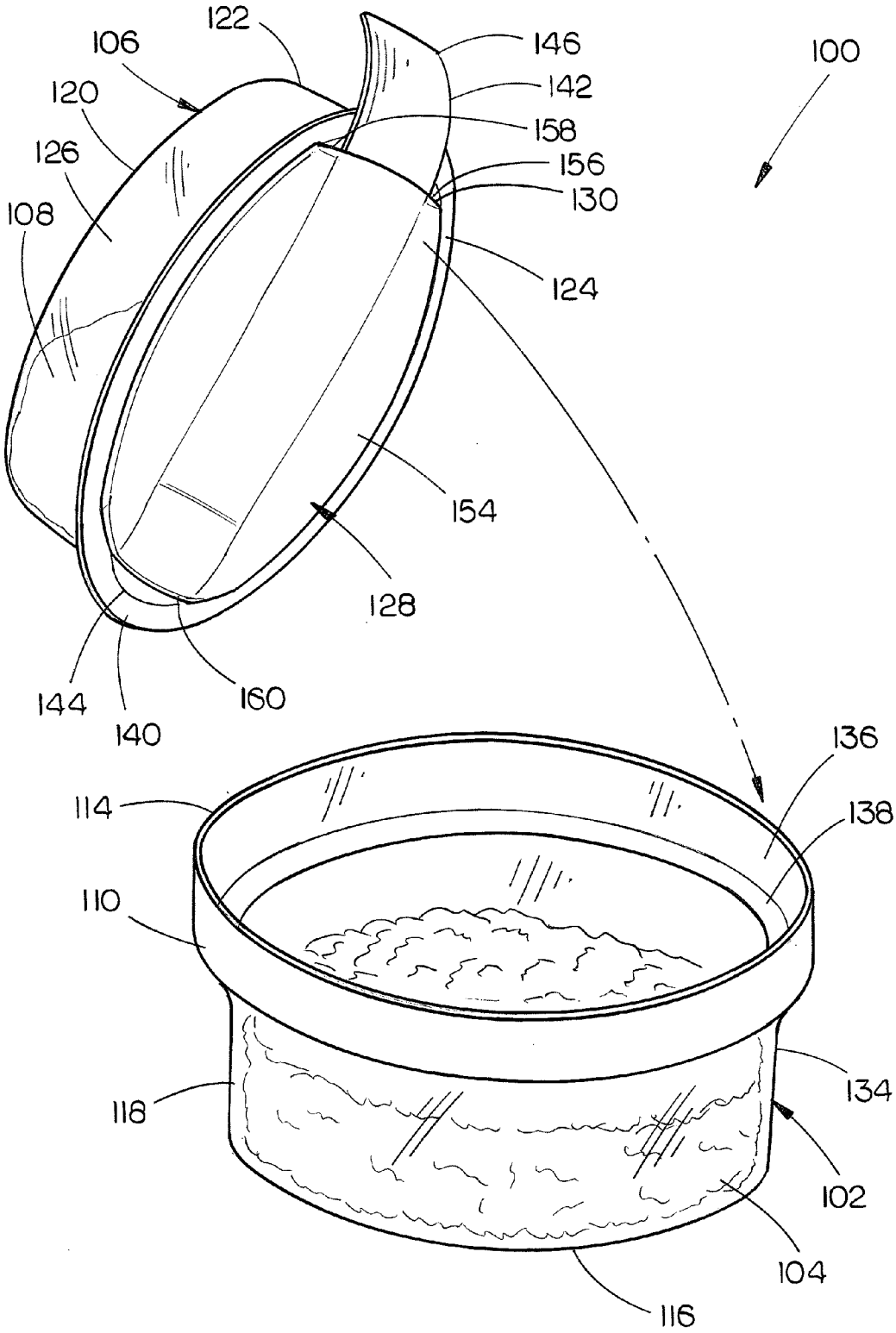
FIG. 10 is an exploded isometric view of the container system shown in FIG. 7, wherein the upper container assembly includes a seal member that is configured to be pulled into a protective sleeve when the upper container assembly is opened.
Figure 11:
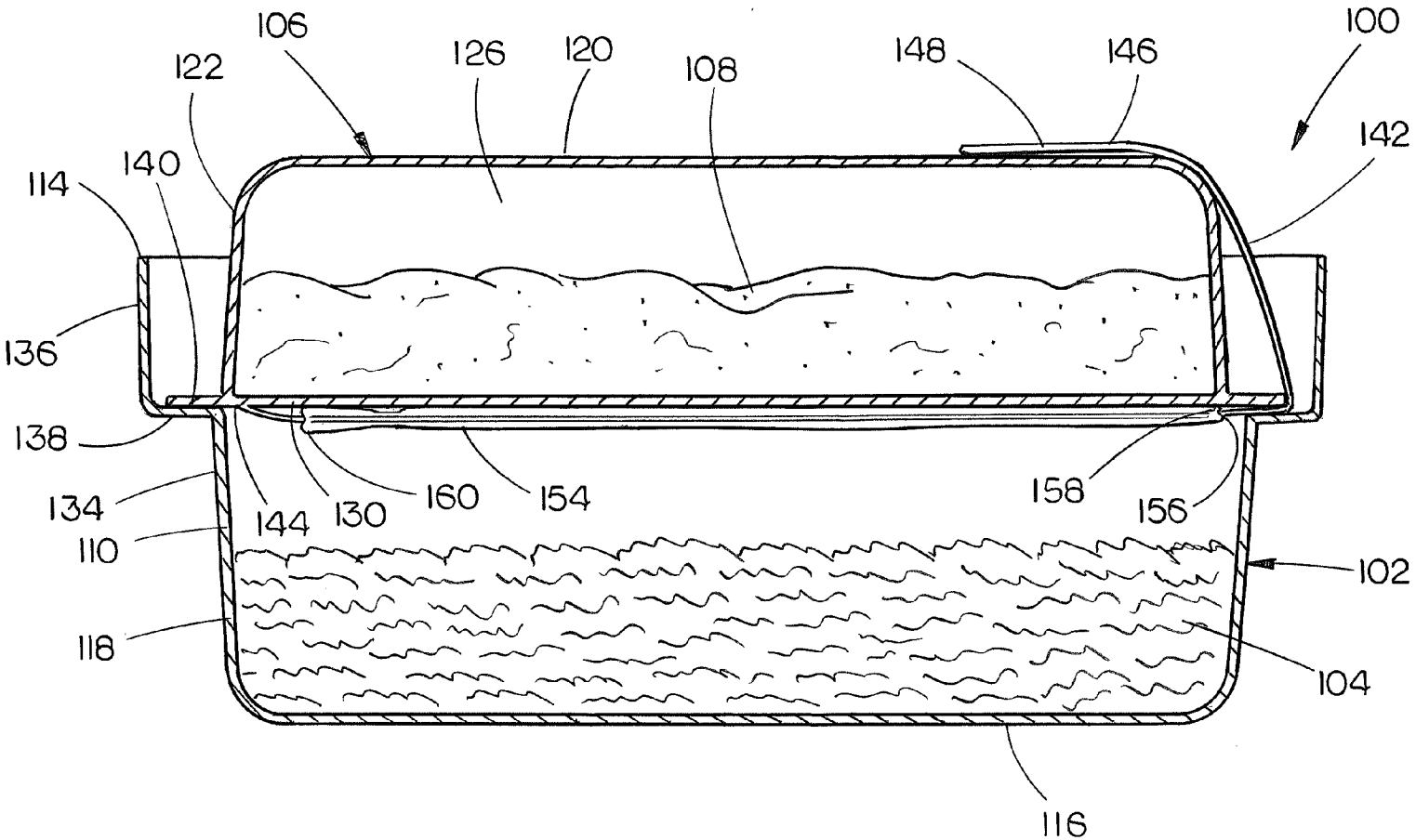
FIG. 11 is a cross-sectional side elevational view of the container system shown in FIG. 10, wherein the container system is shown prior to opening of the upper container assembly.

FIGS. 10 and 11 illustrate an example container system 100, wherein the upper container assembly 106 includes a protective sleeve 154 for receiving the seal member 130 when the upper container assembly 106 is opened. As shown, the protective sleeve 154 includes a first end 156 having a opening 158 and a second end 160 that is coupled to the pull tab 142 adjacent to the seal member 130. Thus, the pull tab 142 initially extends through the protective sleeve 154, which may be held against the seal member 130, e.g., via application of a releasable adhesive applied between the seal member 130 and protective sleeve 154 (e.g., via one or more dots of adhesive).

Figure 12A:
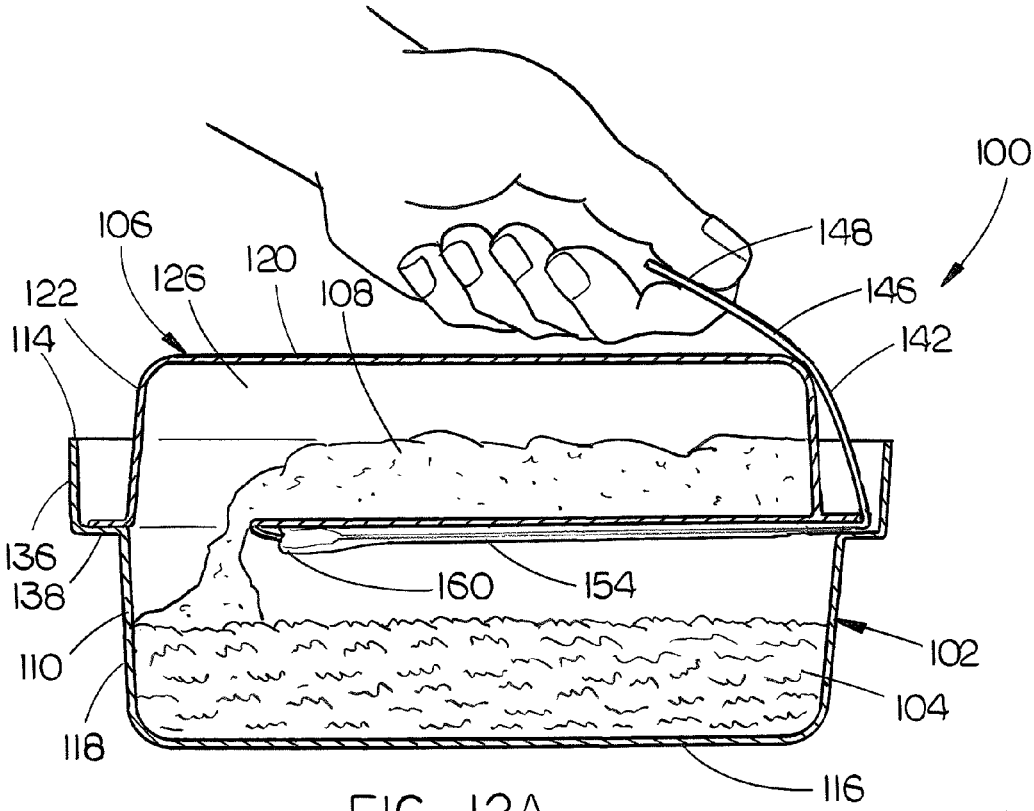
FIG. 12A is a cross-sectional side elevational view of the container system shown in FIG. 10, wherein the container system is depicted during opening of the upper container assembly.
Figure 12B:
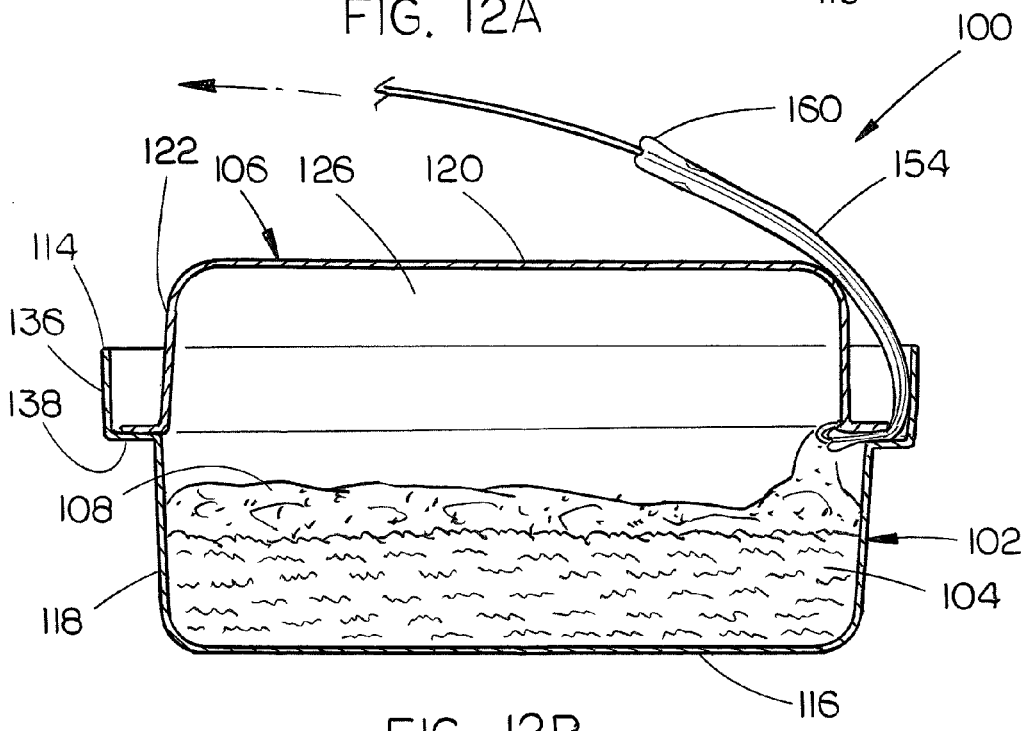
FIG. 12B is a cross-sectional side elevational view of the container system shown in FIG. 10, wherein the container system is depicted following opening of the upper container assembly, wherein the seal member of the upper container assembly is pulled into the protective sleeve.

As shown in FIGS. 12A and 12B, when the pull tab 142 is pulled, the seal member 130 is separated (e.g., peeled back) from the lip 124 of the upper container assembly 106, and is pulled into the protective sleeve 154. The protective sleeve 154 is turned inside out around the seal member 130. In this manner, the seal member 130, which may have residue of the second food component 108 on its surface, remains contained within the protective sleeve 154 when removed from the upper container assembly 106.

Figure 13:
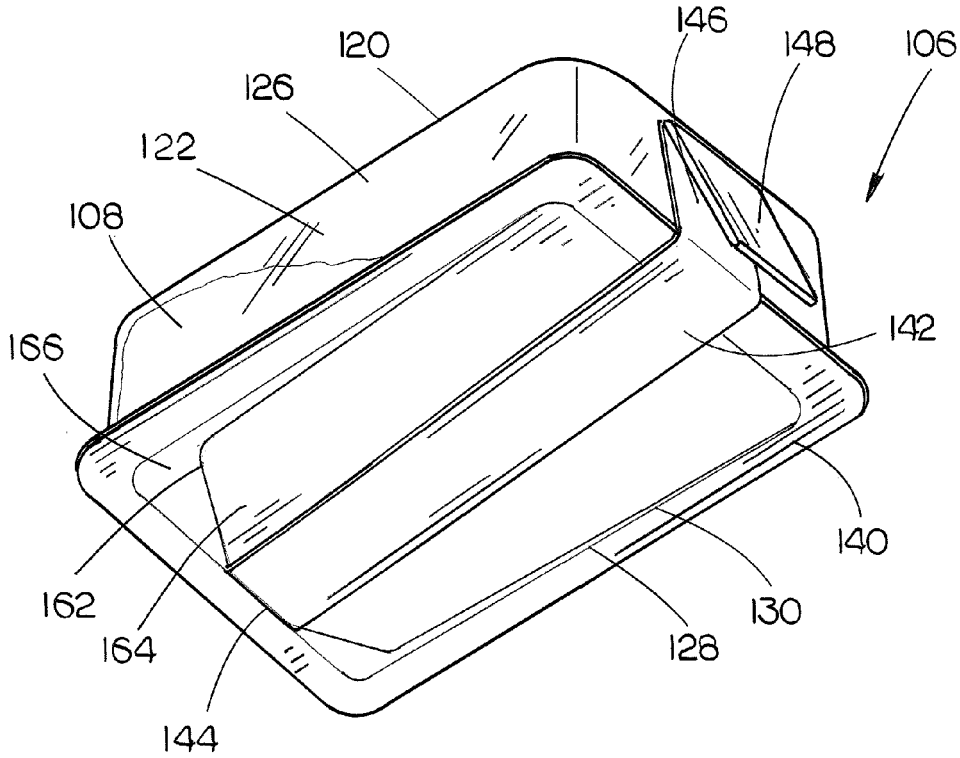
FIG. 13 is an isometric view of the upper container assembly of a container system in accordance with an example implementation, wherein the upper container assembly includes a seal member that comprises a tear line defining a panel which is separated from the remainder of the cover assembly along the tear line to open the upper container assembly.
Figure 14:
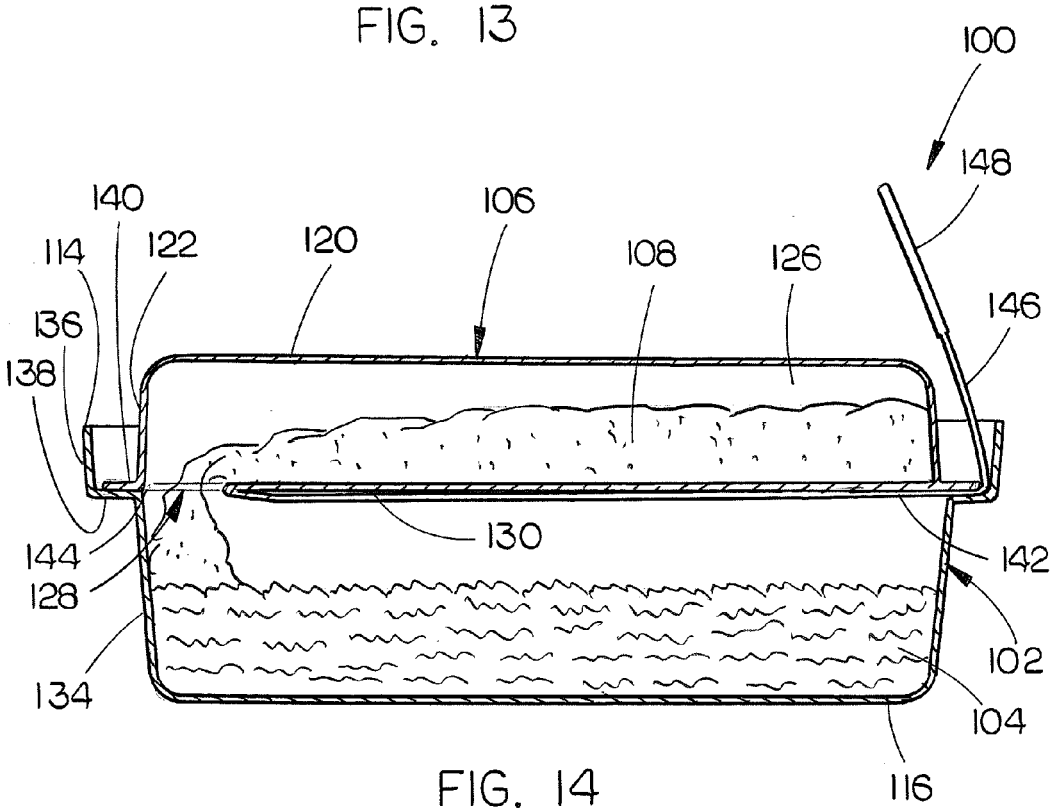
FIG. 14 is a cross-sectional side elevational view that illustrates opening of the upper container assembly shown in FIG. 13.
Figure 15:
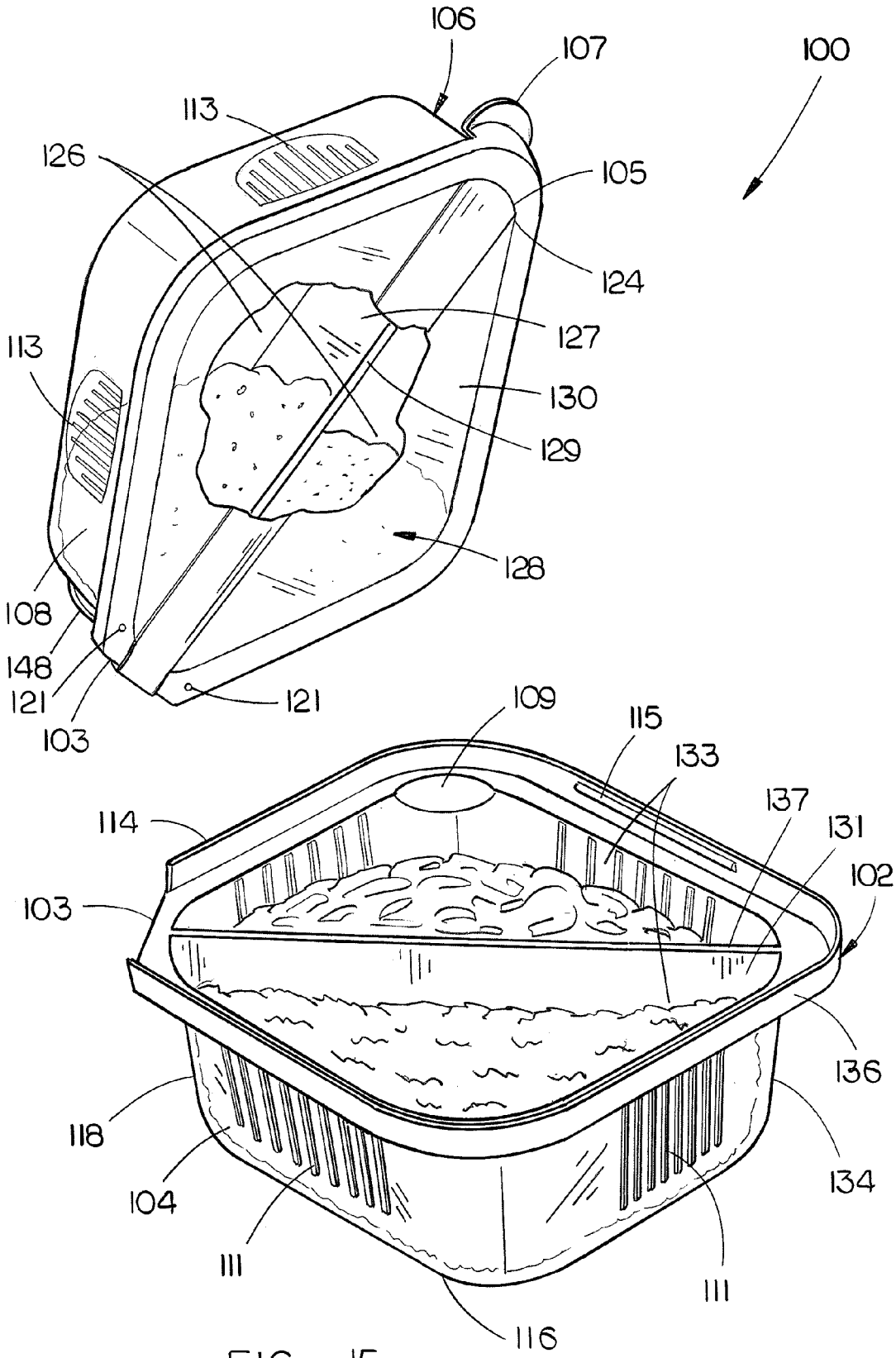
FIG. 15 is an exploded isometric view that illustrates a container system in an example implementation, wherein either one or both of the upper container assembly and the lower container include two or more interior cavities or compartments to contain multiple first and second food products.

FIGS. 13 and 14 illustrate an example upper container assembly 106 of the container system 100. In this example, the seal member 130 comprises a tear line 162 defining a panel 164 which is opened to introduce the second food component 108 into the lower container 102. The panel 164 is configured to be separated from the remainder 166 of the seal member 130 along the tear line 162 when the pull tab 142 is pulled. Thus, as shown in FIG. 11, the seal member 130 is "torn" open along tear line 162 instead of being peeled away from the lip 124 of the upper container assembly 106. In this manner, opening or "peel" area (e.g., the tear line 162) is independent of the seal area (e.g., the area where adhesive is applied to seal the seal member 130 to the lip 124 of the upper container assembly 106). In the embodiment shown, the panel 164 includes a generally triangular end 168 that is configured to facilitate tearing of the seal member material along the tear line 162 when the pull tab 142 is initially pulled (e.g., by reducing the pull force required to initiate tearing). However, panels 164 having other shapes (e.g., curved, rounded, squared, triangular, etc.) are contemplated.

FIG. 15 illustrates an implementation of the container system 100 shown in FIGS. 1 and 2, wherein the upper container assembly 106 includes multiple interior cavities 126 to contain two or more second food products 108 (e.g., two or more different sauces, a sauce and a meat, a sauce and a desert topping, and so on). As shown, the upper container assembly 106 includes one or more one partition walls 127 that separate the interior cavities 126. The seal member 130 may be adhered to an outer edge 129 of the partition walls 127 so that second food component 108 contained in each interior cavity 126 is separated from the second food component 108 contained in other cavities 126.

The lower container 102 may likewise include one or more partition walls 131 dividing the lower container 102 into two or more compartments 133. It is contemplated that, in some embodiments, the lower container 102 may include a second seal member 135 for sealing the first food component 104 within the lower container 102 (See FIG. 16). In such embodiments, each compartment 133 may be individually sealed by the seal member 135 by adhering the seal member 135 to an outer edge 137 of the partition walls 131 so that the second food component 108 contained in each interior cavity 126 is separated from the second food component 108 contained in other cavities 126.

In the example illustrated, the upper container assembly 106 includes a single partition wall 127 so that two interior cavities 126 are provided. Similarly, the lower container 102 includes a single partition wall 131 so that two compartments 133 are provided. As shown, the partition wall 127 of the upper container assembly 106 may be disposed over partition wall 131 of the lower container 102 along a line extending diagonally between the diagonal edge 103 and a corner opposite the diagonal edge 103. In this manner, when the seal member 130 is opened (peeled back), the second food component 108 contained within each interior cavity 126 of the upper container assembly 106 may be released into a corresponding compartment 133 of the lower container assembly without cross-mixing of the different first and second food components 104, 108. Thus, for example, a pasta sauce contained within a first interior cavity 126 may be released into a corresponding first compartment 133 containing dried pasta, while a cheese sauce within a second interior cavity 126 may be released into a compartment 133 containing a freeze-dried vegetable. However, it will be appreciated that the container assembly 100 is not limited to this configuration. For instance, the upper container assembly 106 may include two or more interior cavities 126 that contain first food components that are mixed within a single compartment 133 of the lower container assembly. Thus, for example, a sauce within a first interior cavity 126 and a meat within a second interior cavity may be released into the lower container 102 which contains rice so that the sauce and meat are mixed with the rice. Other configurations are possible.

FIG. 16 illustrates an implementation of the container system 100 shown in FIGS. 1 and 2, wherein the lower container 102 is provided with a second seal member 135. In embodiments, the seal member 135 may be furnished instead of, or in addition to, the seal member 130 of the upper container assembly 106 to hermetically seal the lower container 102. In embodiments, the seal member 135 may comprise of a film such as a biaxially-oriented polyethylene terephthalate (PET) polyester film, a metalized foil film, a paper, other laminations or co-extrusions, and so forth, affixed to the shoulder 140 of the lower container 102 (and/or the outer edge 137 of any partition walls 131) via a suitable adhesive or adhesives.

The seal member 135 may be at least partially removed, such as by peeling the seal member away from the shoulder 140 (and/or the outer edge 137 of any partition walls 131), to allow the first food component 108 to be received in the lower container 102. The seal member 135 may be printable, so that the seal member 135 may also function as a label (e.g., may include cooking directions, cautions, and so forth). A second pull tab 143 is coupled to the seal member 135 to separate (e.g., peel back) the seal member 135 from the shoulder 138 of the lower container 102. The end 145 of the pull tab 143 may include a grip 147 (e.g., a ring structure, a reinforced section, a textured surface, combinations thereof, or the like) that may be gripped to facilitate pulling of the pull tab 143. The pull tab 143 may formed as a single continuous structure, or may be fabricated of two or more components or structures.

Figure 17:
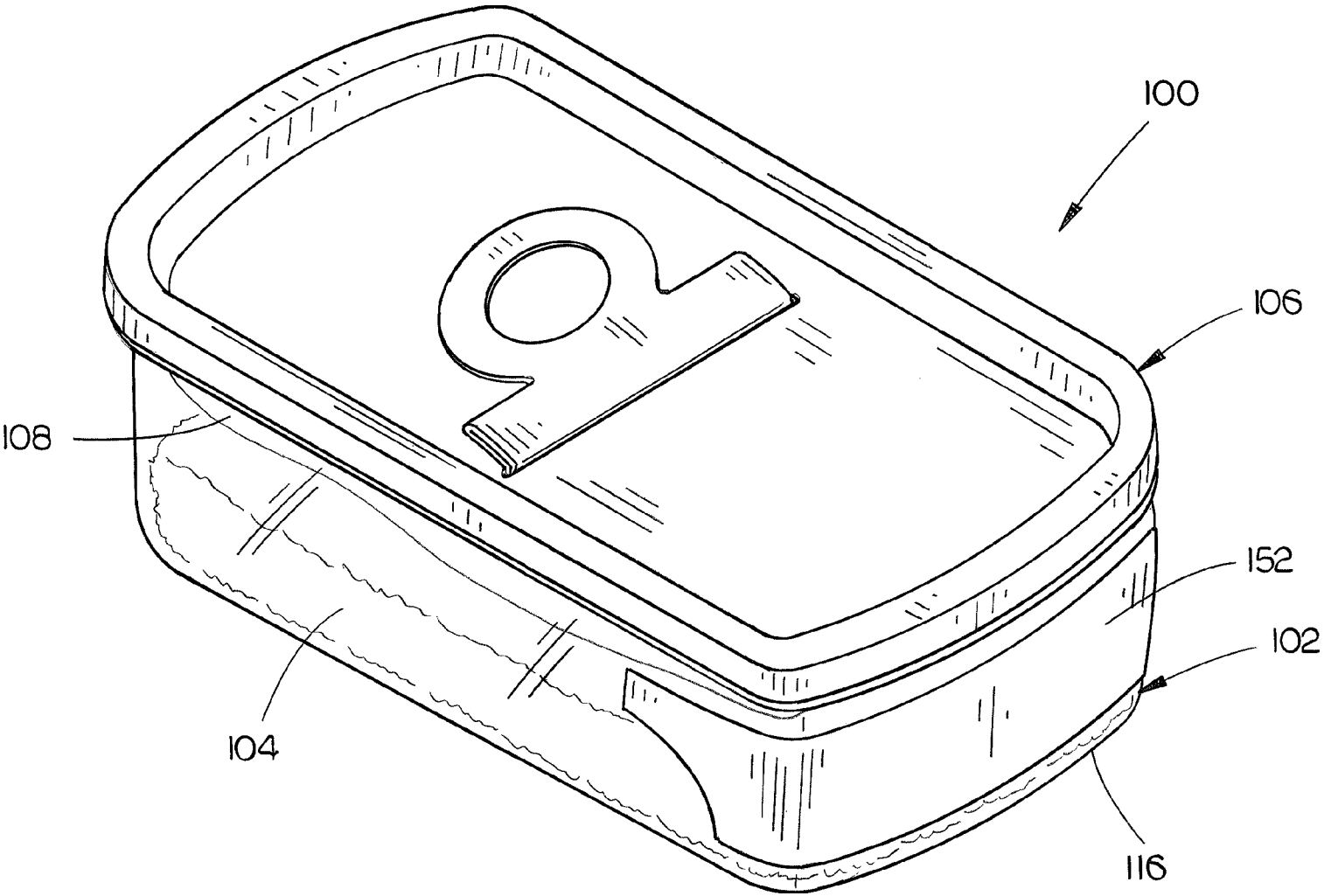
FIG. 17 is an isometric view illustrating a container system in an example implementation, wherein the upper container assembly comprises a lid and a frangible bag that contains the second food product and includes a pull tab extending through a slot formed in the lid for opening the bag.
Figure 18:
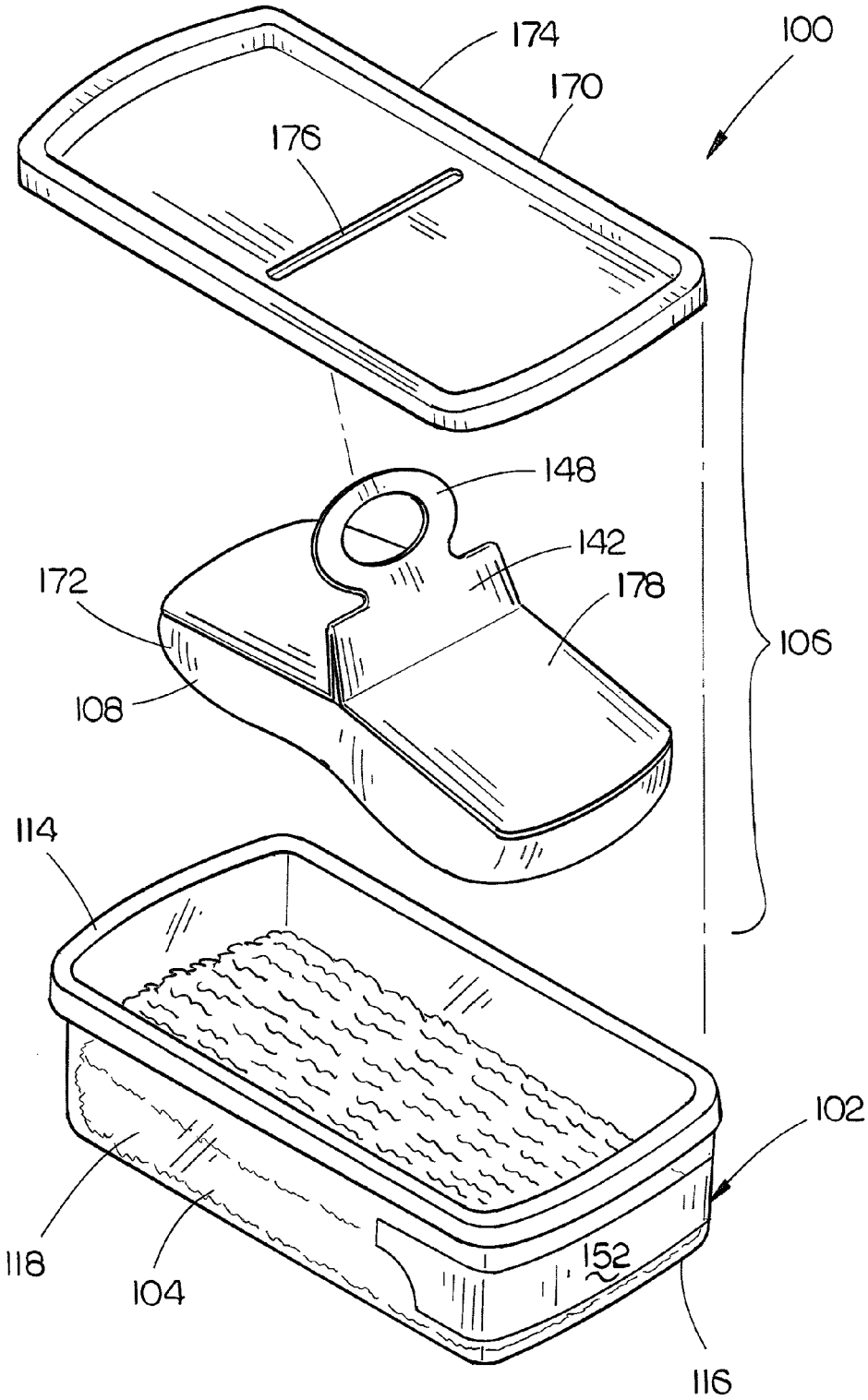
FIG. 18 is an exploded isometric view of the container system shown in FIG. 17, further illustrating components of the container system.
Figure 19:
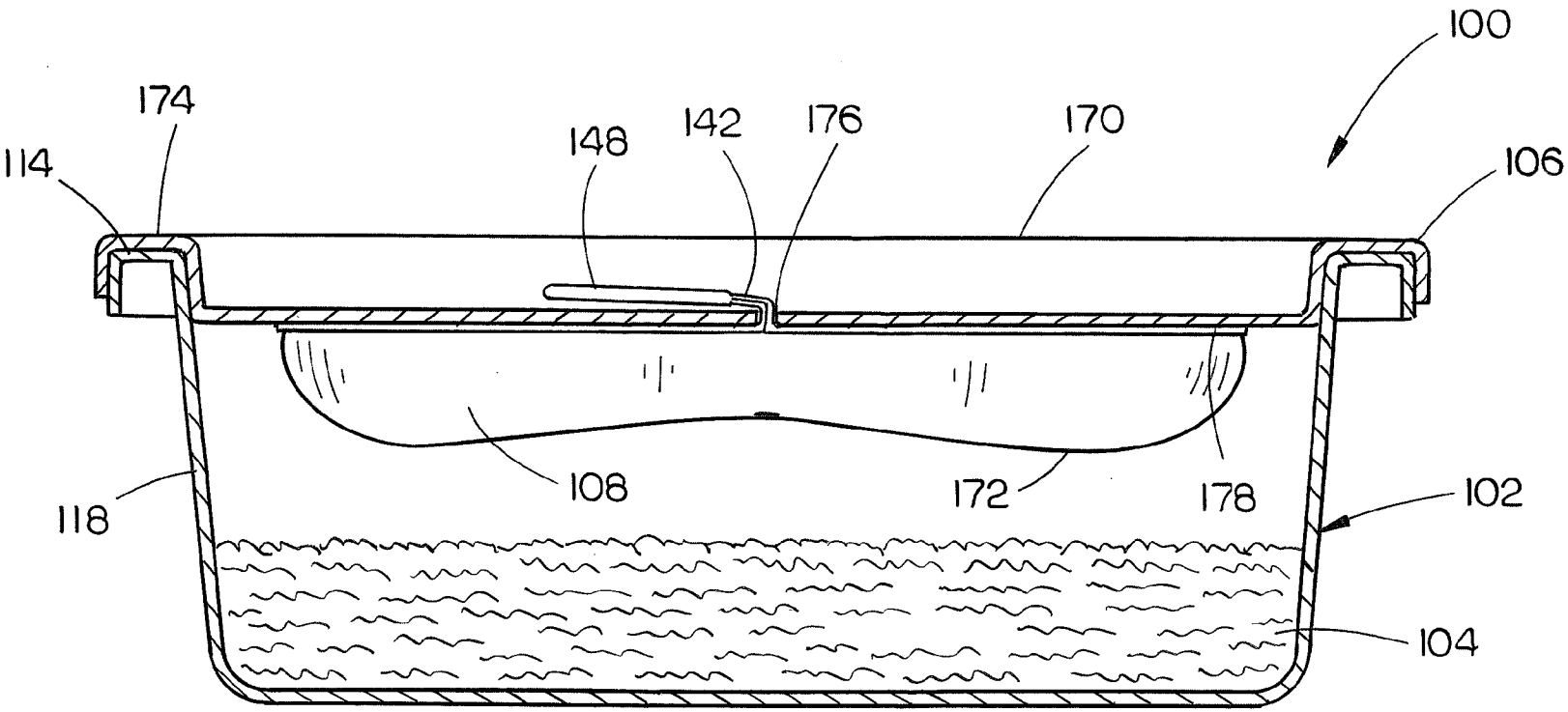
FIG. 19 is a cross-sectional side elevational view of the container system shown in FIG. 17.

In the example shown in FIGS. 17, 18, and 19, the upper container assembly 106 comprises a lid 170 and a frangible bag 172 that contains the second food component 108. As shown, the frangible bag 172 is retained within the lower container 102 by the lid 170. For example, a perimeter edge 174 of the lid 170 is configured to engage the rim 114 of the lower container 102 (e.g., via a snap fit, friction fit, etc.). A pull tab 142 is coupled to the frangible bag 172 and extends through a slot 176 formed within the lid 170. The pull tab 142 may include a grip 148 (e.g., a ring structure, a reinforced portion, a textured surface, combinations thereof, or the like) that may be gripped to facilitate pulling of the pull tab 142. In embodiments, the pull tab 142 may be folded against the outer surface of the lid 170 during shipping and storage of the container system 100.

In FIG. 19, the pull tab 142 is illustrated as being coupled to an upper surface of the frangible bag 172. For example, as shown, the pull tab 142 may include a foldable portion 178 that forms an upper surface for the frangible bag 172 to hold the frangible bag 172 against the inner surface of the lid 170. The lower surface of the frangible bag 172 may be scored or etched to facilitate opening of the bag 172. The pull tab 142 is pulled to at least partially draw the frangible bag 172 through the slot 176, thereby causing the bag to open to introduce the second food component 108 into the lower container 102.

In embodiments, the frangible bag 172 may be formed of a material that is capable of surviving a retort process such as described above, distribution to retailers, storage, and so forth, while providing a low opening force (e.g., a low pull force applied to the pull tab 142). Suitable bag materials may include, but are not limited to: a polyethylene plastic, a biaxially-oriented polyethylene terephthalate (PET) polyester film, a metalized foil, paper, or other laminations or co-extrusions. The second food component 108 may be hermetically sealed within frangible bag 172 until the bag 172 is opened during preparation. It will be understood, however, that the scope of the present disclosure is not limited hermetic sealing of the second food component 108 within the frangible bag 172. The frangible bag 172 and/or the pull tab 142 may further be printable, to function as a label (e.g., may include cooking directions, cautions, and so forth).

Figure 20A:
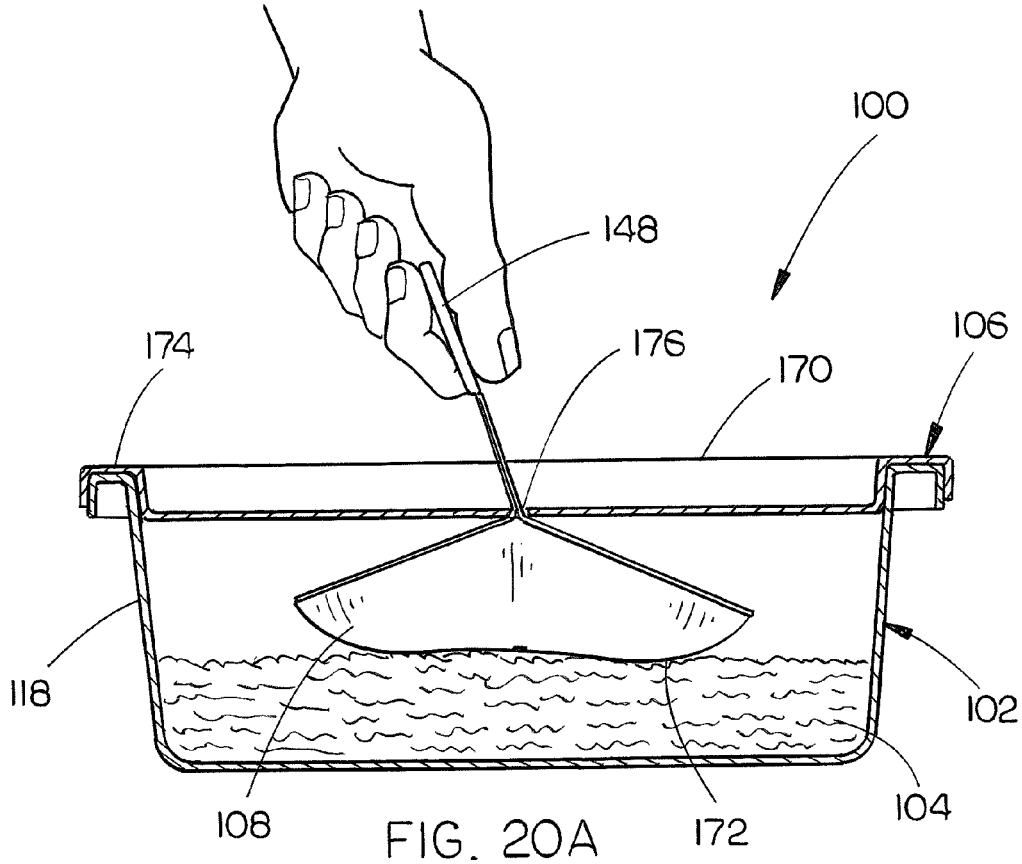
FIG. 20A is a cross-sectional side elevational view of the container system shown in FIG. 17, wherein the container system is depicted after the pull tab is lifted.
Figure 20B:
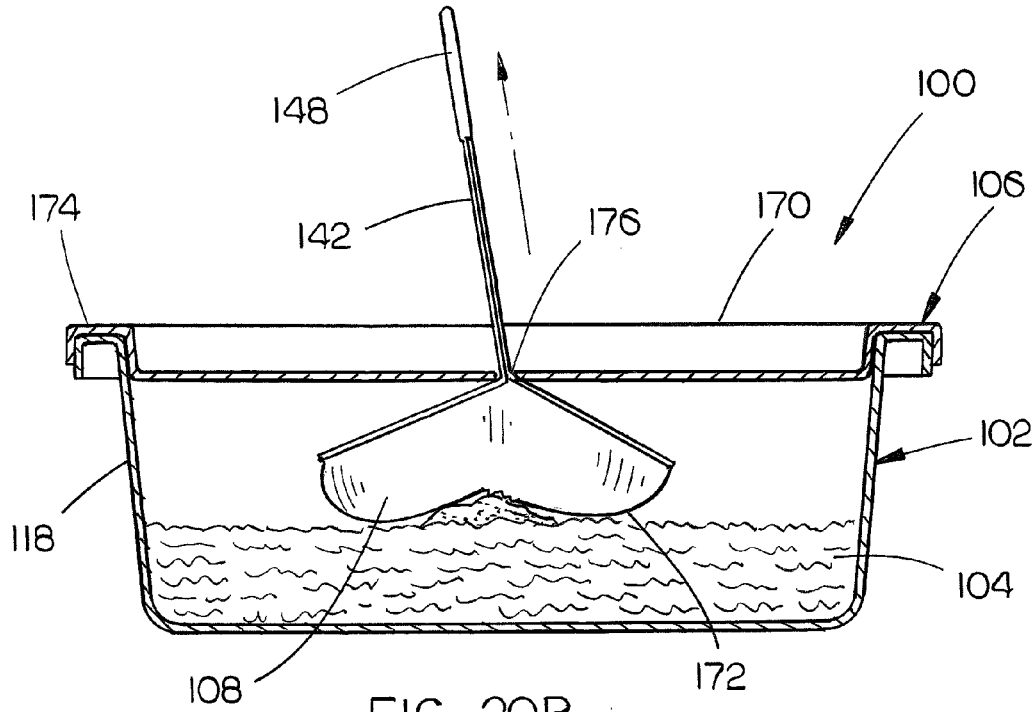
FIG. 20B is a cross-sectional side elevational view of the container system shown in FIG. 17, wherein the container system is depicted after the pull tab is pulled to at least partially draw the bag through the slot to release the second food component from the bag.

FIGS. 20A and 20B illustrate preparation of the contents of the example container system 100 shown in FIGS. 17, 18, and 19. In FIG. 20A, the container system 100 is depicted during opening of the upper container assembly 106. As shown, the grip 148 of pull tab 142 is grasped (e.g., by a consumer) to pull the pull tab 142. As the pull tab 142 is pulled, the foldable portion 178 of the pull tab 142 is drawn through the slot 176 causing the foldable portion 178 to be folded downward against the frangible bag 172. This folding increases pressure within the frangible bag 172, causing the bag 172 to open along its bottom surface or side edges (e.g., along a scored or etched line in the bottom surface of the bag 172) to release the second food component 108 into the lower container 102.

In embodiments, the frangible bag 172 is removed through the slot 176 after the second food component 108 is introduced into the lower container 102. The slot 176 may then function as a vent to release steam and other gases during cooking of the first and second food components 104, 108 in the lower container 102. Other venting structures (e.g., holes, additional slots, etc.) may also be provided in the lid 170.

Figure 21:
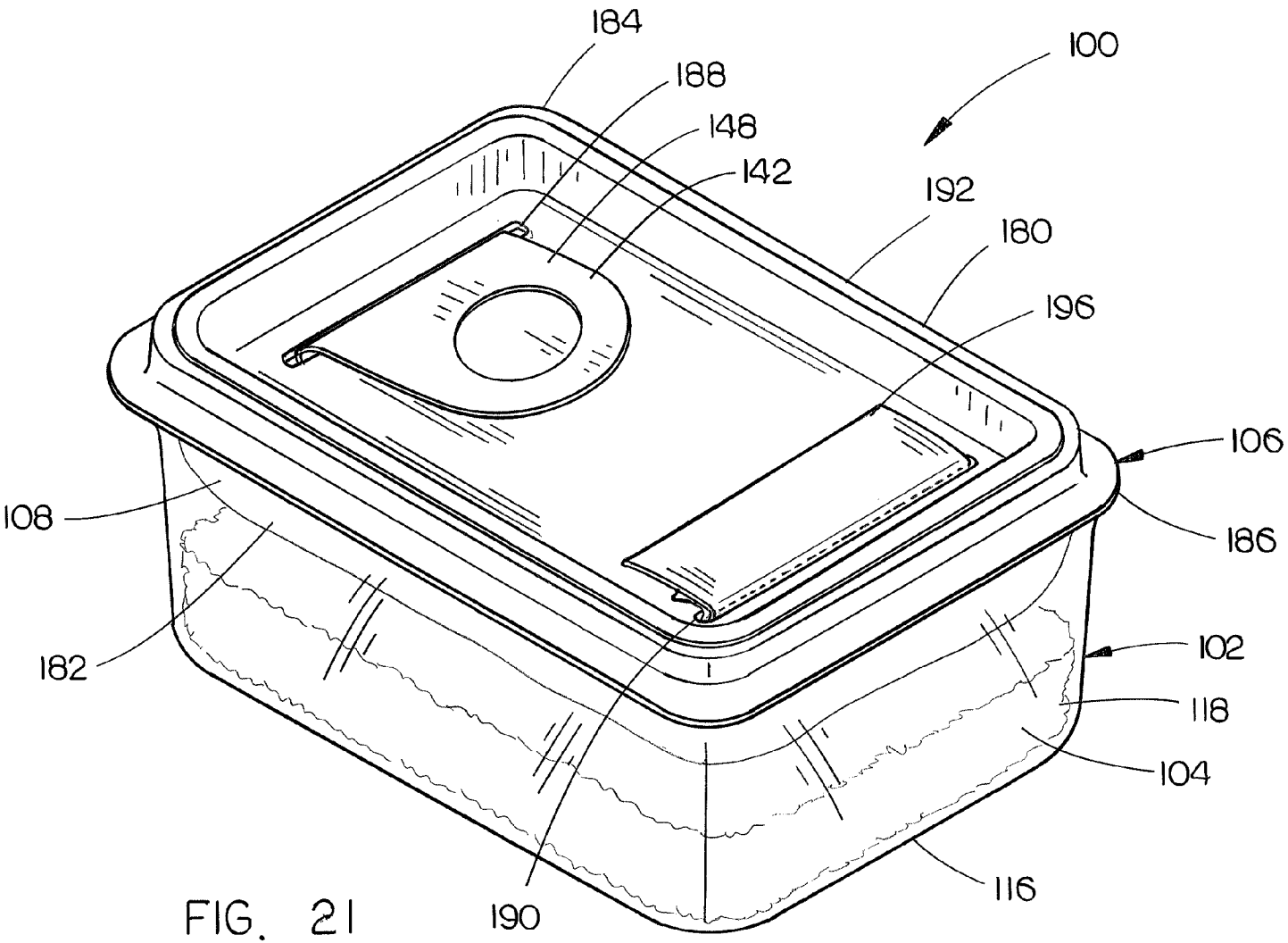
FIG. 21 is an isometric view illustrating a container system in an example implementation, wherein the upper container assembly comprises a lid including a first end having a first slot and a second end having a second slot and a bag that contains the second food product and includes a pull tab extending through the first slot and a tear tab extending through the second slot.
Figure 22:
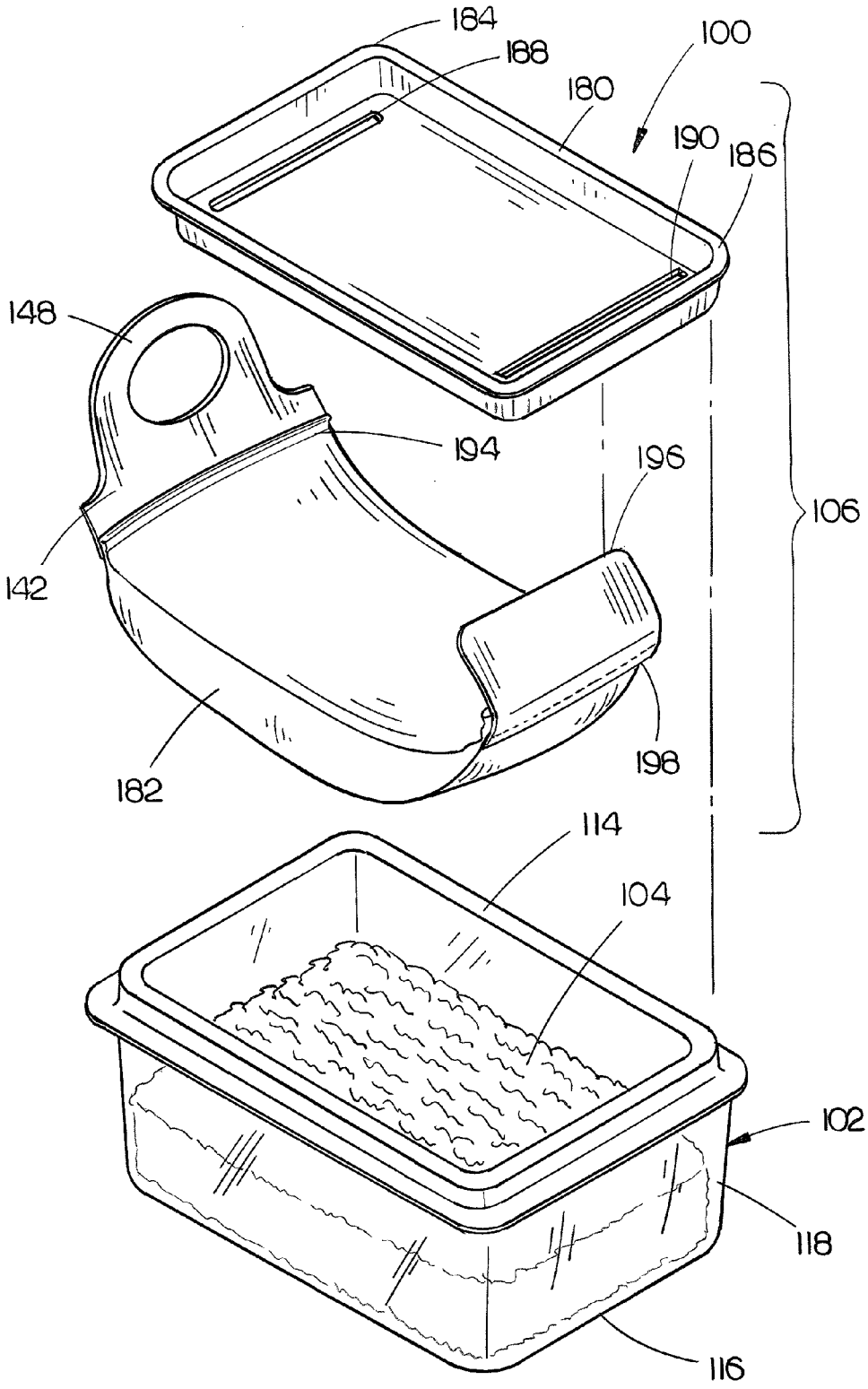
FIG. 22 is an exploded isometric view of the container system shown in FIG. 21, further illustrating components of the container system.

In the example shown in FIGS. 21 and 22, the upper container assembly 106 comprises a lid 180 and a bag 182 that contains the second food component 108. As shown, the lid 180 includes a first end 184 and a second end 186, opposite the first end 184. A first slot 188 is provided in the lid 180 adjacent to the first end 184, and a second slot 190 is provided in the lid 180 adjacent to the second end 186. In embodiments, the first and second slots 188, 190 are formed within the surface of the lid 180 as shown in FIG. 21. However, it is contemplated that the first and second slots 188, 190 may also be formed along an edge of so that the slots are disposed between the lid 180 and the rim 114 of the lower container 102. A perimeter edge 192 of the lid 180 is configured to engage the rim 114 of the lower container 102 (e.g., via a snap fit) to restrain the bag 182 within the container 102.

As illustrated, the pull tab 142 is coupled to a first end 194 of the bag 182 and extends through the first slot 188. Similarly, a tear tab 196 is coupled to a second end 198 of the bag 182 and extends through the second slot 190. The pull tab 142 and/or the tear tab 196 may include a grip 148 (e.g., a ring structure, a reinforced portion, a textured surface, combinations thereof, or the like) that may be gripped to facilitate pulling of the tab 142, 196, and may be folded against the outer surface of the lid 180 during shipping and storage of the container system 100.

The tear tab 196 is removed from the bag 182 to open the bag within the lower container 102. In embodiments, the bag 182 may be scored or etched to along the bottom of the tear tab 196 facilitate opening of the bag 172 when the tear tab 196 is removed. The pull tab 142 may then be pulled to at least partially draw the bag 182 through the first slot 184 to cause the second food component 108 to be introduced into the lower container 102.

In embodiments, the bag 182 may be formed of a material that is capable of surviving a retort process such as described above, distribution to retailers, storage, and so forth, while providing a low opening force (e.g., a low pull force applied to the pull tab 142). Suitable bag materials may include, but are not limited to: a polyethylene plastic, a biaxially-oriented polyethylene terephthalate (PET) polyester film, a metalized foil, paper, or other laminations or co-extrusions. The second food component 108 may be hermetically sealed within bag 182 until the bag 182 is opened during preparation. It will be understood, however, that the scope of the present disclosure is not limited hermetic sealing of the second food component 108 within the bag 182. The bag 182, the pull tab 142, and/or the tear tab 196 may further be printable, to function as a label (e.g., may include cooking directions, cautions, and so forth).

Figure 23A:
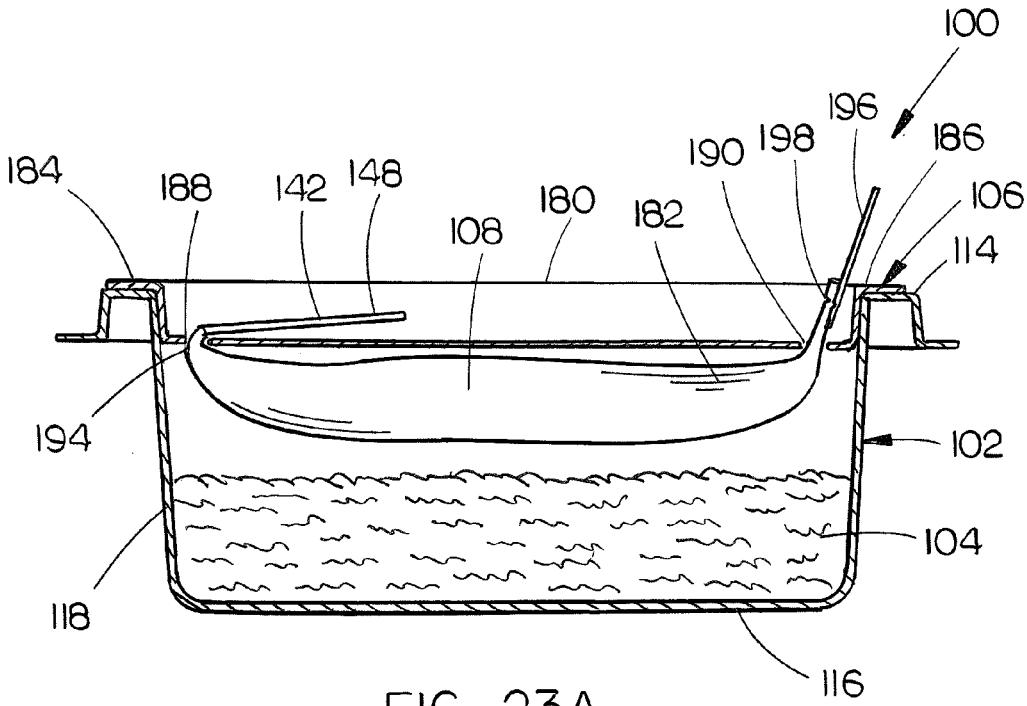
FIG. 23A is a cross-sectional side elevational view of the container system shown in FIG. 21, wherein the container system is depicted prior to opening of the upper container assembly.

FIGS. 23A through 23D illustrate preparation of the contents of the example container system 100 shown in FIGS. 21 and 22. In FIG. 23A, the container system 100 is depicted prior to opening of the upper container assembly 106. The bag 182 is contained within the lower container 102 and is restrained therein by the lid 180. The second food component 108 is contained within the bag 182, which separates the second food component 108 from the first food component 104 contained within the lower container 102 below the bag 182. The pull tab 142 and tear tab 196 extend through slots 188, 190, respectively.

Figure 23B:
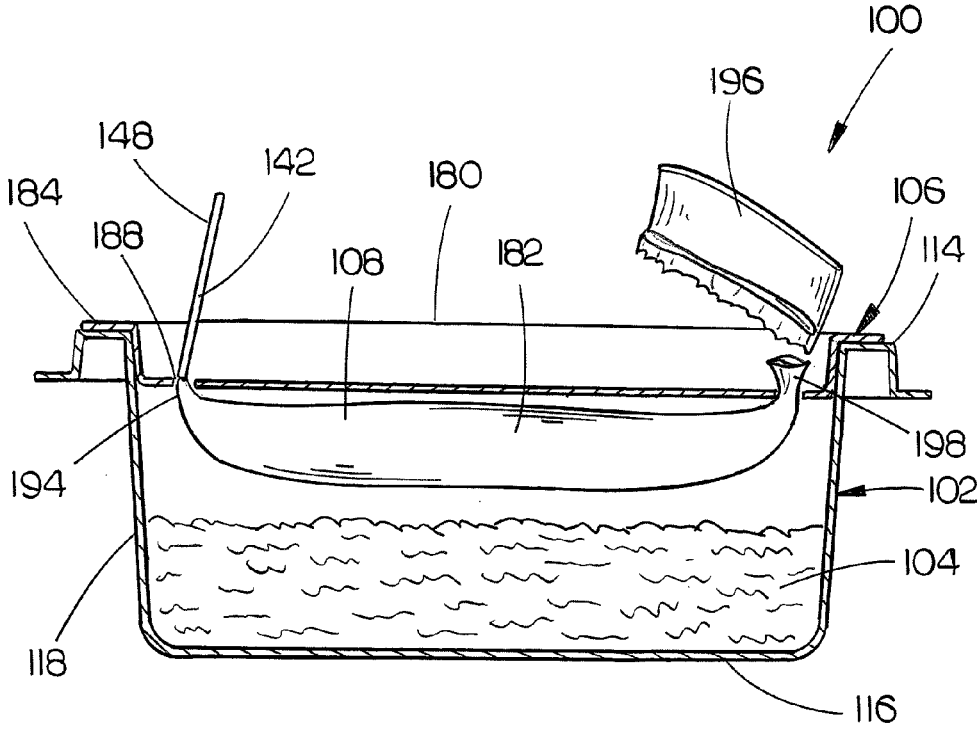
FIG. 23B is a cross-sectional side elevational view of the container system shown in FIG. 21, wherein the container system is depicted after the tear tab of the bag is removed from the bag.

In FIG. 23B, the container system 100 is depicted during opening of the upper container assembly 106. As shown, the tear tab 196 may be grasped and pulled in a direction generally parallel to the top surface of the lid 180 and along the length of the second slot 190 to remove the tab 196 from the bag 182. Removal of the tear tab 196 opens the bag 182 along the second end 198, allowing the second food component 108 to be released from the bag 182. In embodiments, the second end 198 of the bag 182 is held closed by the second slot 190 after the tear tab 190 is removed to prevent spillage of the second food component 108. However, it is also contemplated that in some embodiments the second end 198 of the bag 182 may drop into the lower container 102 through the second slot 190 after the tear tab 196 is removed, allowing some of the second food component 108 to be released into the container 102.

Figure 23C:
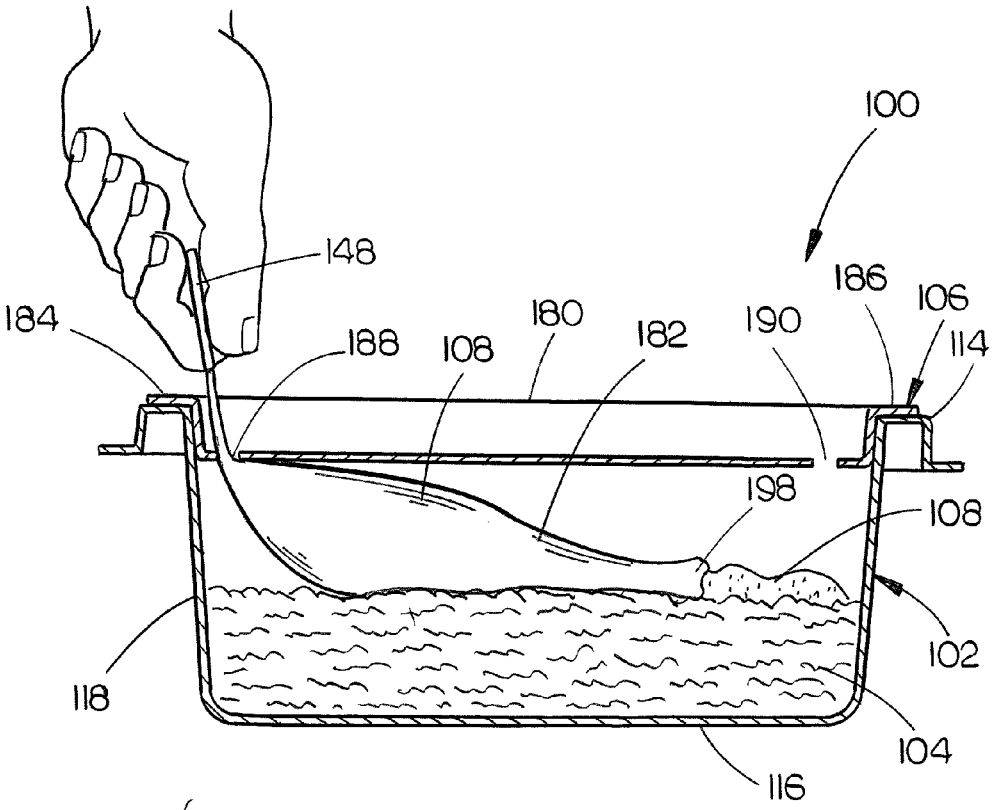
FIG. 23C is a cross-sectional side elevational view of the container system shown in FIG. 21, wherein the container system is depicted after the pull tab is pulled to at least partially draw the bag through the first slot.

In FIG. 23C, the container system 100 is depicted after the tear tab 196 is removed. As shown, the grip 148 of the pull tab 142 is grasped (e.g., by a consumer) to pull the tab 142. As the pull tab 142 is pulled, the bag 182 is drawn through the first slot 184, which compresses the bag 182 and causes the second food component 108 to be introduced into the lower container 102 through the opened second end 198.

Figure 23D:
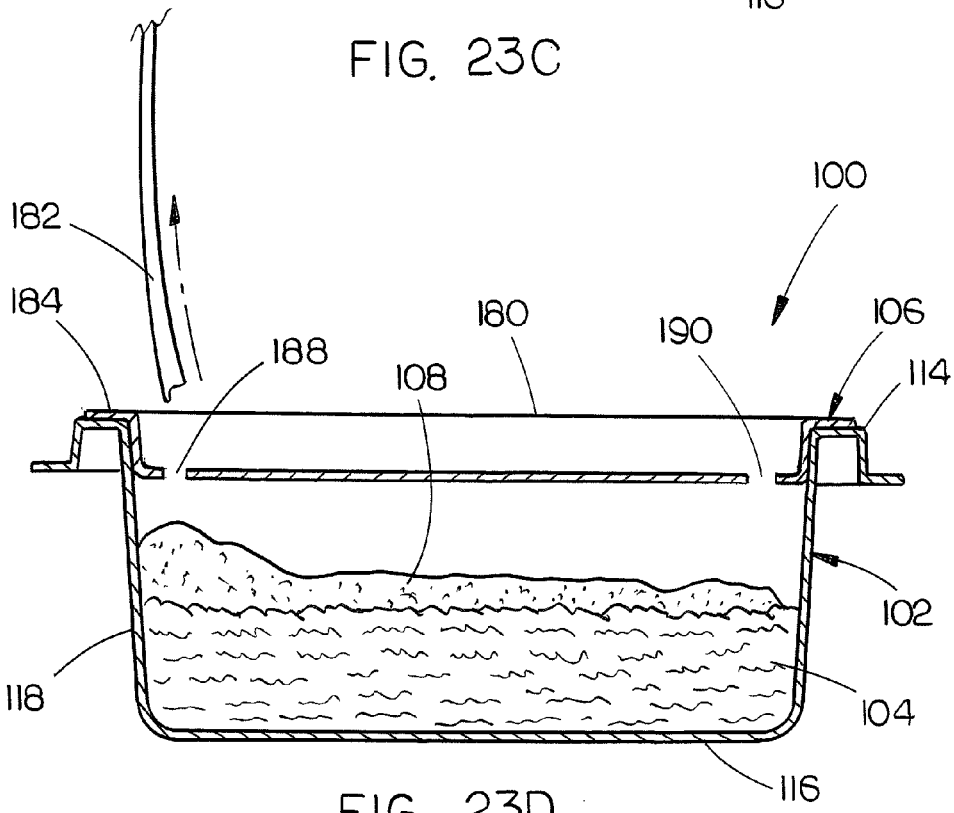
FIG. 23D is a cross-sectional side elevational view of the container system shown in FIG. 21, wherein container system is depicted after the bag has been removed from the lid.

In FIG. 23D, the container system 100 is depicted after the bag 182 has been removed from the container system 100 through the first slot 184. In some implementations, the container system 100 may be shaken gently to mix the second food component 108 into the first food component. In embodiments, the first and second slots 184, 186 may function as vents to release steam and other gases during cooking of the first and second food components 104, 108 in the lower container 102. Other venting structures (e.g., holes, additional slots, etc.) may also be provided in the lid 180.

Example Procedures

Figure 24:
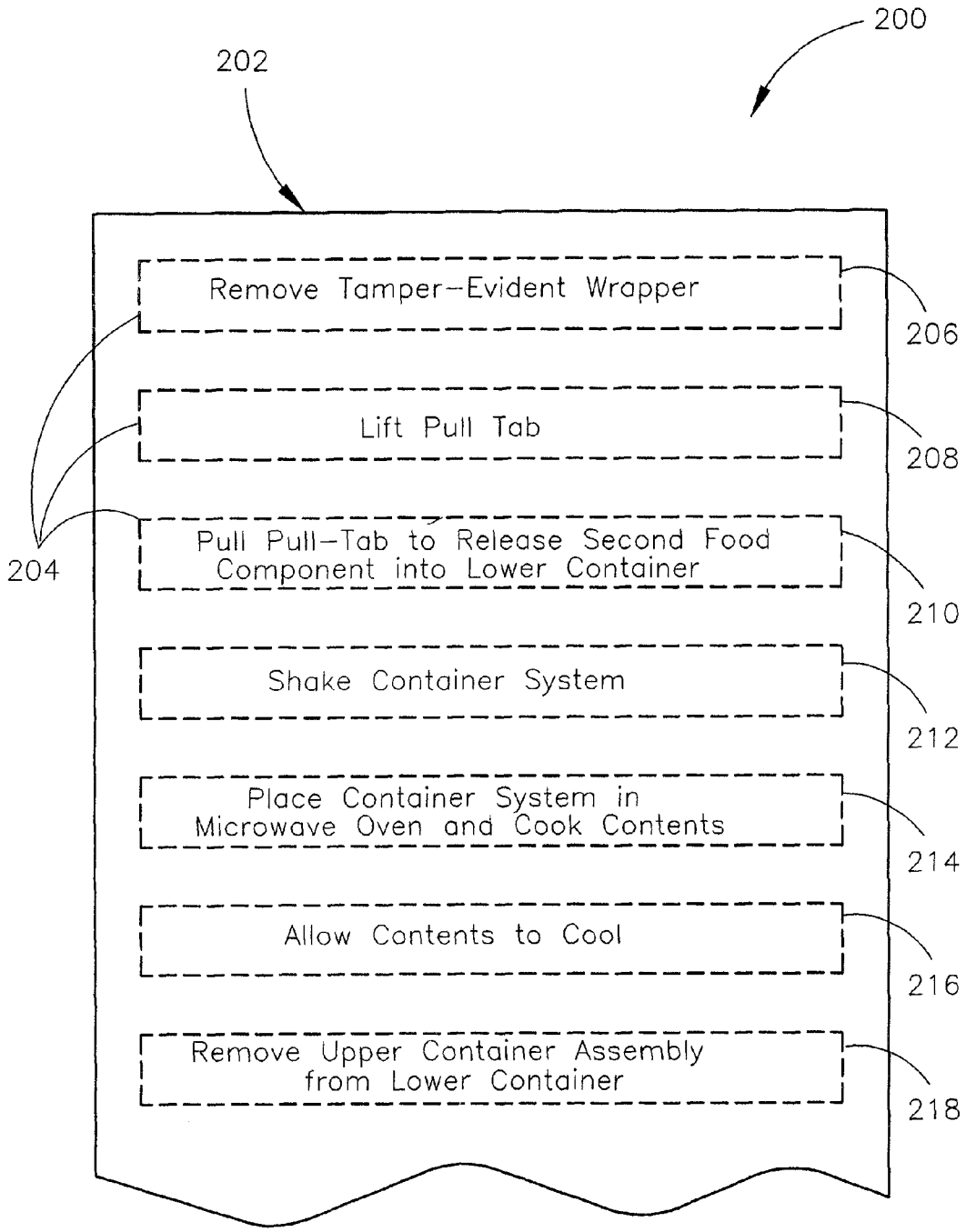
FIG. 24 is a flow diagram illustrating a procedure for cooking contents of the container system shown in FIGS. 1 through 20B.
Figure 25:
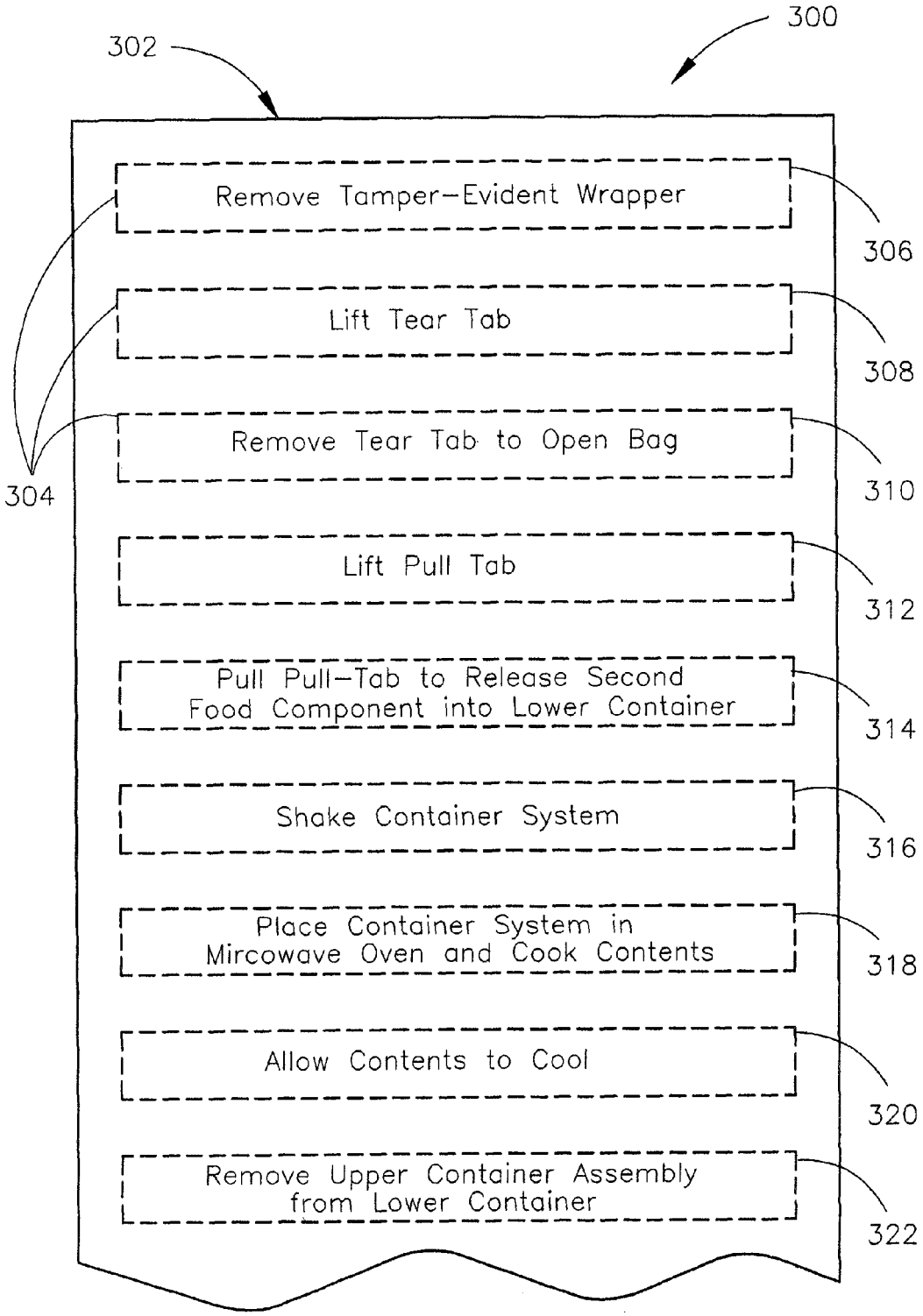
FIG. 25 is a flow diagram illustrating a procedure for cooking contents of the container system shown in FIGS. 21 through 23D.

FIGS. 24 and 25 illustrate procedures 200, 300 in example implementations that are suitable for use with the container systems 100 of FIGS. 1 through 20B and FIGS. 21 through 23D, respectively, to prepare the contents (e.g., first and second food components 104, 108) of the container systems 100. As shown, the procedures 200, 300 may be embodied as a set of instructions 202, 302. The set of instructions 202, 302 may be disposed on a label affixed to the lower container 102, the upper container assembly 106, seal member 130, a tamper-evident wrapping, a bag 172, 182, and so forth. The set of instructions 202, 302 include instructions 204, 304 that direct the consumer to prepare the first and second food components 104, 108 using the container system 100. In one aspect of the present disclosure, the sets of instructions 202, 302 can include text, graphics, symbols, colors, and so forth. Further, it will be appreciated that the various instructions provided by the sets of instructions 202, 302 may be altered (e.g., instructions may be added, deleted, or modified) without departing from the scope and spirit of the present disclosure.

In the example depicted in FIG. 24, the set of instructions 202 instructs the consumer to remove the tamper-evident sleeve (block 206) and lift the end of the pull tab (block 208). The set of instructions 202 then instructs the consumer to pull the pull tab (block 210) to release the second food component into the lower container. Next, the set of instructions 202 may instruct the consumer to shake the container system (block 212) to further mix the second food component with the first food component, and to place the container system (block 214) containing the first and second food components in a microwave oven to cook the contents for a specified duration of time. The set of instructions 202 may further caution the consumer to allow the contents of the container system to cool (block 216) for a specified duration of time prior to removal of the upper container assembly from the lower container. The set of instructions (block 202) then instructs the consumer to remove the upper container assembly from the lower container (block 218) so that the contents may be consumed.

In the example depicted in FIG. 25, the set of instructions 302 instructs the consumer to remove the tamper-evident sleeve (block 306) and lift the end of the tear tab (block 308). The set of instructions 302 then instructs the consumer to remove the tear tab from the bag (bock 310) to open the bag. Next, the set of instructions 302 instructs the consumer to lift the pull tab (block 312) and pull the pull tab (block 314) to release the second food component into the lower container. The set of instructions 302 may then instruct the consumer to shake the container system (block 316) to further mix the second food component with the first food component and place the container system containing the first and second food components in a microwave oven to cook the components for a specified duration of time (block 318). The set of instructions 302 may further caution the consumer to allow the contents of the container system to cool (block 320) for a specified duration of time prior to removal of the upper container assembly from the lower container. The set of instructions 302 then instructs the consumer to remove the upper container assembly from the lower container (block 322) so that the contents may be consumed.

CONCLUSION

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A packaged microwavable product, comprising:

a first food component;

a second food component;

a lower container maintaining the first food component, wherein the lower container includes a base, a lower wall extending upwardly from the base, and a shoulder extending outwardly from the lower wall, wherein the shoulder is slanted with respect to the base;

an upper container maintaining the second food component, wherein the upper container includes a base, a sidewall and a flange extending outwardly from the sidewall, wherein the flange is supported by the slanted shoulder of the lower container;

a seal member adhered to a lip of the flange of the upper container to provide separation between the first food component and the second food component; and a pull tab coupled to the seal member and extending between the slanted shoulder of the lower container and the flange of the upper container to facilitate movement of the seal member from a closed position to an open position, wherein the lip includes a first lip portion and a second lip portion, wherein the second lip portion has a width that is about equal to or greater than the first lip portion, wherein the seal member is adhered to the first lip portion with a lesser adhesive bond than the second lip portion so the seal member remains within the lower container when in the final open position, wherein at least a portion of the seal member remains adhered to the lip when in the final open position.

2. The packaged microwavable product of claim 1, wherein the base of the upper container is slanted with respect to the flange of the upper container.

3. The packaged microwavable product of claim 1, wherein the base of the upper container is substantially horizontal with respect to the base of the lower container.

4. The packaged microwavable product of claim 1, wherein the shoulder of the lower container is substantially parallel with respect to the flange of the upper container.

5. The packaged microwavable product of claim 1, wherein the seal member is sloped when the lower container is in a generally level orientation.

6. The packaged microwavable product of claim 1, further comprising a containment wall extending upwardly from the slanted shoulder of the lower container, wherein the upper container nests at least partially within a volume formed by the containment wall.

7. A packaged microwavable product, comprising:

a first food component;

a flowable sauce component;

a lower container maintaining the first food component, wherein the lower container includes a base, a lower wall extending upwardly from the base, and a shoulder extending outwardly from the lower wall, wherein the shoulder is slanted with respect to the base;

an upper container maintaining the sauce component, wherein the upper container includes a base, a sidewall and a flange extending outwardly from the sidewall, wherein the flange is supported by the slanted shoulder of the lower container;

a seal member adhered to a lip of the flange of the upper container to provide separation between the first food component and the sauce component; and a pull tab coupled to the seal member and extending between the slanted shoulder of the lower container and the flange of the upper container to facilitate movement of the seal member from a closed position to an open position, wherein the lip includes a first lip portion and a second lip portion, wherein the second lip portion has a width that is about equal to or greater than the first lip portion, wherein the seal member is adhered to the first lip portion with a lesser adhesive bond than the second lip portion so the seal member remains within the lower container when in the final open position, wherein at least a portion of the seal member remains adhered to the lip when in the final open position.

8. The packaged microwavable product of claim 7, wherein the base of the upper container is slanted with respect to the flange of the upper container.

9. The packaged microwavable product of claim 7, wherein the base of the upper container is substantially horizontal with respect to the base of the lower container.

10. The packaged microwavable product of claim 7, wherein the shoulder of the lower container is substantially parallel with respect to the flange of the upper container.

11. The packaged microwavable product of claim 7, wherein the seal member is sloped when the lower container is in a generally level orientation.

12. The packaged microwavable product of claim 7, further comprising a containment wall extending upwardly from the slanted shoulder of the lower container, wherein the upper container nests at least partially within a volume formed by the containment wall.

13. A packaged microwavable product, comprising:

a first food component;

a second food component;

a lower container maintaining the first food component, wherein the lower container includes a base, a lower wall extending upwardly from the base, and a shoulder extending outwardly from the lower wall, wherein the shoulder is slanted with respect to the base;

an upper container maintaining the second food component, wherein the upper container includes a base, a sidewall and a flange extending outwardly from the sidewall, wherein the flange is supported by the slanted shoulder of the lower container;

a seal member adhered to a lip of the flange of the upper container to provide separation between the first food component and the second food component, wherein the lip includes a first lip portion and a second lip portion, wherein the seal member is adhered to the first lip portion with a lesser adhesive bond than the second lip portion; and a pull tab coupled to the seal member and extending between the slanted shoulder of the lower container and the flange of the upper container to facilitate movement of the seal member from a closed position to a final open position, wherein the seal member is removed from the first lip portion and adhered to the second lip portion when in the final open position so that the seal member remains within the lower container.

14. The packaged microwavable product of claim 13, further comprising a containment wall extending upwardly from the slanted shoulder of the lower container, wherein the upper container nests at least partially within a volume formed by the containment wall.

* * * * *